US008463156B2

(12) United States Patent
Akutsu et al.

(10) Patent No.: US 8,463,156 B2
(45) Date of Patent: Jun. 11, 2013

(54) IMAGE FORMING APPARATUS WITH MOVABLE CARTRIDGE SUPPORTING MEMBER

(75) Inventors: Takashi Akutsu, Odawara (JP); Ken Kikuchi, Mishima (JP); Tsutomu Nishiuwatoko, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 12/843,474

(22) Filed: Jul. 26, 2010

(65) Prior Publication Data

US 2011/0033201 A1 Feb. 10, 2011

(30) Foreign Application Priority Data

Aug. 4, 2009 (JP) ..... 2009-181735
Jul. 16, 2010 (JP) ..... 2010-161226

(51) Int. Cl.
*G03G 15/00* (2006.01)

(52) U.S. Cl.
USPC ..... 399/110; 399/13; 399/111; 399/112; 399/119

(58) Field of Classification Search
USPC ..... 399/110, 111, 112, 119, 12, 13
See application file for complete search history.

(56) References Cited

U.S. PATENT DOCUMENTS 5,585,902 A 12/1996 Nishiuwatoko et al.
5,815,644 A 9/1998 Nishiuwatoko et al.
5,870,655 A 2/1999 Nishiuwatoko et al.
5,893,006 A 4/1999 Kanno et al.
5,937,240 A 8/1999 Kanno et al.
5,943,528 A 8/1999 Akutsu et al.
6,009,288 A 12/1999 Akutsu
6,070,029 A 5/2000 Nishiuwatoko et al.
6,078,764 A 6/2000 Akutsu
6,115,569 A 9/2000 Akutsu
6,141,508 A 10/2000 Sasaki et al.
6,714,746 B2 3/2004 Morioka et al.
6,832,057 B2 12/2004 Oguma et al.

(Continued)

FOREIGN PATENT DOCUMENTS

JP 58-192055 11/1983
JP 04174450 A * 6/1992

(Continued)

OTHER PUBLICATIONS

Office Action in Japanese Patent Application No. 2010-161226, dated Jul. 25, 2011, (with the excerpted English translation).

*Primary Examiner* — David Gray
*Assistant Examiner* — Laura Roth
(74) *Attorney, Agent, or Firm* — Fitzpatrick, Cella, Harper & Scinto

(57) ABSTRACT

An image forming apparatus for forming an image on a recording material includes a cartridge accommodating a developer for developing an electrostatic latent image formed on a photosensitive member, a supporter detachably mounting the cartridge, and a preventor. The supporter moves between an inside position where the cartridge forms an image inside a main assembly of the apparatus and an outside position where the cartridge is mounted and demounted outside the main assembly. The preventor moves between a first position in which it prevents, when the cartridge is not mounted, movement of the supporter from the outside position to the inside position by contacting a portion thereof, and a second position, retracted from the first position, in which the it permits, when the cartridge is mounted, the movement of the supporter from the outside position to the inside position.

16 Claims, 25 Drawing Sheets

U.S. PATENT DOCUMENTS

| | | | |
|---|---|---|---|
| 2007/0104530 | A1 * | 5/2007 | Tamehira et al. |
| 2007/0189781 | A1 * | 8/2007 | Katogi et al. |
| 2010/0080615 | A1 | 4/2010 | Kikuchi |
| 2010/0135691 | A1 | 6/2010 | Kikuchi |
| 2010/0158559 | A1 | 6/2010 | Kikuchi et al. |

FOREIGN PATENT DOCUMENTS

| | | | |
|---|---|---|---|
| JP | 2007-213025 | A | 8/2007 |
| JP | 2009-0163274 | | 7/2009 |
| JP | 2010002827 | A * | 1/2010 |

* cited by examiner (a)

(b)

(a)

(b)

(a)

(b)

(a)

(b)

(a)

(b)

(c)

(a)

(b)

(a)

(b)

(a)

(b)

(a)

(b)

(a)

(b)

(a)

(b)

IMAGE FORMING APPARATUS WITH MOVABLE CARTRIDGE SUPPORTING MEMBER

FIELD OF THE INVENTION AND RELATED ART

The present invention relates to an image forming apparatus including a cartridge supporting member to which a cartridge is mountable and relates to the cartridge.

In an electrophotographic image forming apparatus using an electrophotographic image forming process, a process cartridge system integrally including a photosensitive drum, a developing roller and a developing unit or a developing cartridge system constituted only by the developing unit provided separately from the photosensitive drum has been known. These process cartridge system and developing cartridge system can be performed by a user alone without relying on a service person when the user performs maintenance of the apparatus, thus being used widely in the electrophotographic image forming apparatus.

As the image forming apparatus, in addition to a monochromatic image forming apparatus in which image formation is effected by using only a black toner, a color image forming apparatus using color toners of yellow, magenta, cyan and black has been put into practical use. At the color image forming apparatus, the image forming apparatus of a tandem type in which process cartridges or developing cartridges corresponding to the color toners (hereinafter, these cartridges are collectively referred to as a "cartridge") are disposed side by side has been known.

In the above-described image forming apparatus, such a constitution that a cartridge supporting member capable of mounting the cartridges is provided and can be pulled out from the inside of an apparatus main assembly to a predetermined position has been disclosed in Japanese Laid-Open Patent Application (JP-A) 2007-213025. According to the constitution, the cartridge supporting member is pulled out to the predetermined position and then the user can easily exchange the cartridges of various types.

However, in the image forming apparatus of the type disclosed in JP-A 2007-213025, when the user mounts the cartridges for the respective colors in the cartridge supporting member, the cartridge supporting member is not configured so that the user can recognize whether or not the cartridges for the respective colors are properly mounted in associated mounting portions with reliability. For each of the colors, various conditions relating to image formation, such as a developing bias and the like are changed, so that there is a possibility that a high-quality image cannot be obtained in the case where the cartridge has been mounted in a mounting portion different from a predetermined mounting portion.

SUMMARY OF THE INVENTION

A principal object of the present invention is to provide an electrophotographic image forming apparatus enabling a user to recognize unmounting or incomplete mounting of a cartridge when the user inserts a cartridge supporting member into an apparatus main assembly in the case where the cartridge is unmounted in the cartridge supporting member or is incompletely mounted in the cartridge supporting member.

Another object of the present invention is to provide an electrophotographic image forming apparatus enabling the user to recognize the unmounting or the incomplete mounting of the cartridge when the user inserts the cartridge supporting member into the apparatus main assembly in the case where the cartridge is not mounted at a predetermined position of the cartridge supporting member.

According to an aspect of the present invention, there is provided an image forming apparatus for forming an image on a recording material, comprising:

a cartridge including a developer accommodating portion for accommodating a developer for developing an electrostatic latent image formed on a photosensitive member;

a cartridge supporting member including a mounting portion in which the cartridge is detachably mountable, the cartridge supporting member being movable between an inside position in which an image is to be formed by the cartridge mounted in the mounting portion inside a main assembly of the image forming apparatus and an outside position in which the cartridge is to be mounted and demounted outside the main assembly; and a preventing member movable between a first position in which the preventing member prevents, when the cartridge is not mounted in the mounting portion, movement of the cartridge supporting member from the outside position to the inside position by contacting a portion to be prevented, and a second position in which the preventing member permits, when the cartridge is mounted in the mounting portion, the movement of the cartridge supporting member from the outside position to the inside position, wherein the second position is retracted from the first position.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1A:
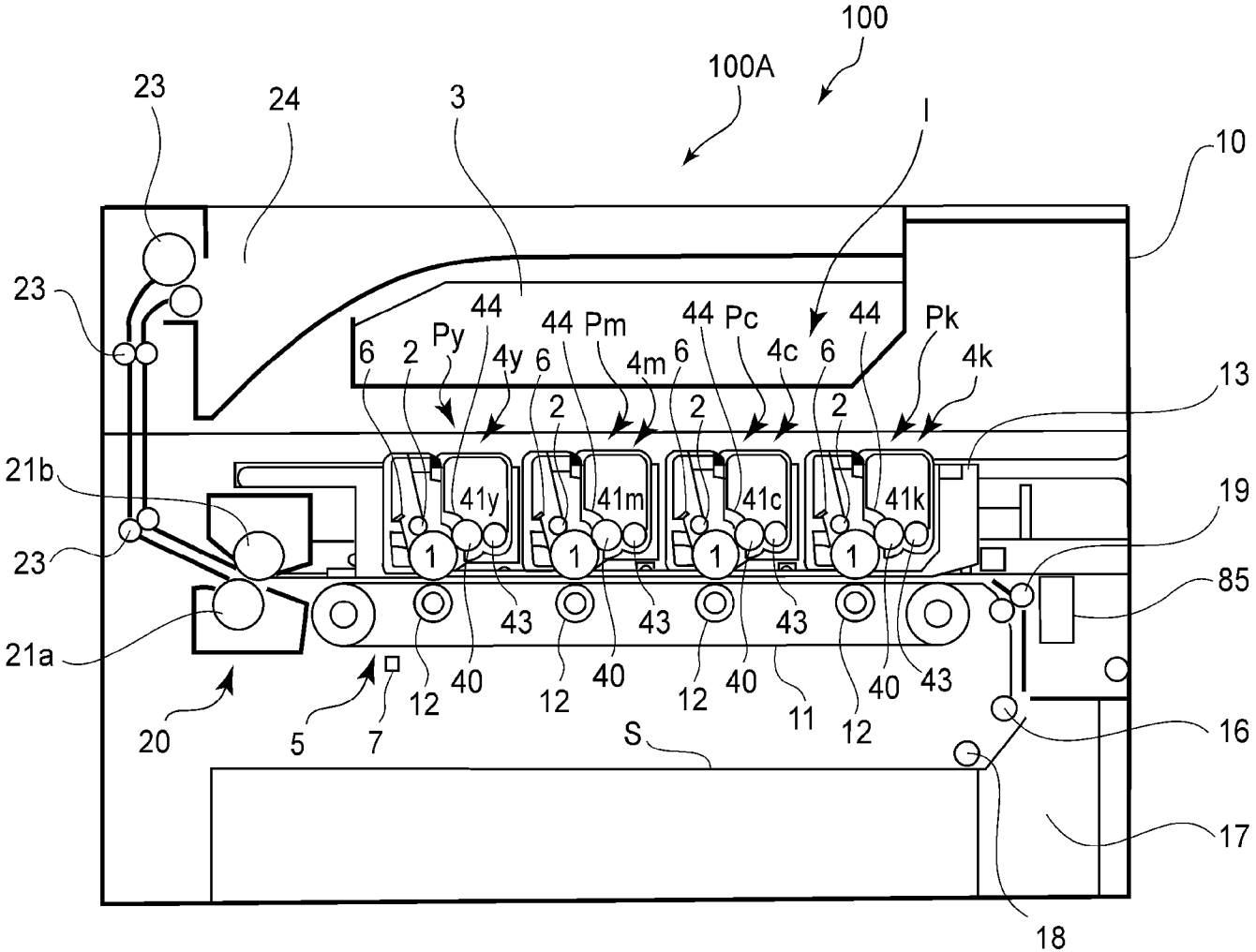
FIGS. 1A and 1B are sectional views showing a structure of an image forming apparatus in Embodiment 1 according to the present invention.

Embodiments of the present invention will be described more specifically with reference to the drawings. Dimensions, materials, configurations, relative positions, and so on of constituent parts which will be described hereinafter may be appropriately changed depending on the structures and various conditions of an image forming apparatus to which the present invention is applied, and the present invention is not limited thereto unless otherwise specified particularly.

A color electrophotographic image forming apparatus described later forms a color image on the recording material using an electrophotographic image forming process. Examples of the color electrophotographic image forming apparatus include a color electrophotographic copying machine, a color electrophotographic printer (color laser beam printer, color LED printer, etc.), a color facsimile machine and a color word processor.

The recording material may include paper, an OHP sheet, etc.

A cartridge described later is, e.g., a process cartridge, a developing cartridge or a toner cartridge and contributes to an image forming process for forming the image on the recording material in a state in which the cartridge is detachably mounted in an apparatus main assembly of the electrophotographic image forming apparatus. Here, the process cartridge includes at least one of a charging means, a developing means, and a cleaning means as process means, and an electrophotographic photosensitive drum, which are integrally assembled into a unit (cartridge), and the cartridge is detachably mountable to the apparatus main assembly of the electrophotographic image forming apparatus. Thus, the process cartridge may include the developing means as the process means and the electrophotographic photosensitive drum as the unit, and the unit is detachably mountable to the apparatus main assembly. The process cartridge may include the charging means, the developing means, or the cleaning means as the process means and the electrophotographic photosensitive drum as the unit, and the unit is detachably mountable to the apparatus main assembly.

The process cartridge which is provided integrally with the electrophotographic photosensitive drum and the developing means is called an integral-type process cartridge. The process cartridge which is provided integrally with the electrophotographic photosensitive drum and the process means other than the developing means is called a separation type process cartridge. The process cartridge can be mounted into and demounted form the apparatus main assembly. For this reason, the maintenance of the apparatus main assembly is easy. The process means acts on the electrophotographic photosensitive drum.

The developing cartridge is provided with a developing roller, and accommodates a developer (toner) used for developing an electrostatic latent image formed on the electrophotographic photosensitive drum and is detachably mountable to the apparatus main assembly. In the case of the developing cartridge, the electrophotographic photosensitive drum is mounted in the apparatus main assembly or a cartridge supporting member described later. Alternatively, the electrophotographic photosensitive drum is provided in the so-called separation type process cartridge. In this case, the process cartridge is not provided with the developing means. The developing cartridge can also be mounted into and demounted from the apparatus main assembly by the user alone. For this reason, the maintenance of the apparatus main assembly is easy.

Therefore, the cartridge in the present invention includes the process cartridges of the so-called the integral type and the so-called separation type. The cartridge includes a pair of the process cartridge of the separation type and the developing cartridge. In another example of the cartridge, the electrophotographic photosensitive drum is mounted fixedly in the apparatus main assembly or the cartridge supporting member and the detachably mountable developing cartridge is used so as to be actable on the electrophotographic photosensitive drum.

Embodiment 1

FIG. 1A is a sectional view showing a structure of an electrophotographic image forming apparatus 100 in this embodiment according to the present invention. As shown in FIG. 1A, the image forming apparatus 100 includes an electrophotographic image forming apparatus main assembly 100A. To the apparatus main assembly 100, a pulling-out member (drawing member) 13, which is a cartridge supporting member, in which process cartridges P (Py, Pm, Pc, Pk) are detachably mountable is detachably mountable.

The image forming apparatus 100 includes four electrophotographic photosensitive drums 1, which are an image bearing member, disposed horizontally side by side. Each of the photosensitive drums 1 is rotationally driven in a clockwise direction in the figure by a driving mechanism (driving means). Around each of the photosensitive drums 1, a charging device 2, a scanner unit 3, a developing unit 4 (4*y*, 4*m*, 4*c*, 4*k*), an electrostatic transfer device 5 and a cleaning device 6 are disposed in this order along a rotational direction of the photosensitive drum 1.

The photosensitive drum 1 is prepared by, e.g., applying an OPC (organic photoconductor) photosensitive member onto an outer circumferential surface of an aluminum cylinder. The photosensitive drum 1 is rotationally supported by a supporting member at its end portions. At one end portion, a drum coupling for receiving a driving force from a driving motor (not shown) is disposed. As a result, the photosensitive drum 1 is rotationally driven in the clockwise direction in FIG. 1A.

The charging device 2 as a charging means is a device for electrically charging the surface of the photosensitive drum 1 uniformly. The charging device 2 used in this embodiment is of a contact charging type as shown in FIG. 1A. A charging member is an electroconductive charging roller formed in a roller shape. The charging roller contacts the surface of the photosensitive drum 1. To this charging roller, a charging bias voltage is applied. As a result, the surface of the photosensitive drum 1 is electrically charged uniformly.

The scanner unit forms an electrostatic image (electrostatic latent image) on the photosensitive drum 1 by irradiating the photosensitive drum 1 with a laser beam on the basis of image information. The scanner unit 3 is disposed above the photosensitive drum 1. The charged surface of the photosensitive drum 1 is selectively exposed to image light corresponding to an image signal by a laser diode (not shown). As a result, the electrostatic image is formed depending on the image signal.

The developing units 4 (4*y*, 4*m*, 4*c* and 4*k*) accommodate developers (toners) of yellow, magenta, cyan and black, respectively, and develop the electrostatic image with the toner. Specifically, the developing units 4 include a toner container 41*y* accommodating the yellow toner, a toner container 41*m* accommodating the magenta toner, a toner container 41*c* accommodating the cyan toner, and a toner container 41*k* accommodating the black toner. Each of the toners in the toner containers 41 (41*y*, 41*m*, 41*c* and 41*k*) is fed to a toner feeding roller 43. Then the toner is fed by the toner feeding roller 43 and is applied onto another circumferential surface of a developing roller 40 (developing member) by a developing blade 44 press-contacting the outer circumferential surface of the developing roller 40. Further, electric charges are imparted to the toner. Then, by applying a developing bias to the developing roller 40, the electrostatic image formed on the photosensitive drum 1 is developed with the toner. The developing roller 40 is disposed opposite to the photosensitive drum 1.

The developing unit 4 and the photosensitive drum 1 integrally constitute the cartridge P (Py, Pm, Pc and Pk). The cartridge P can be exchanged as a whole when the toner is consumed by the use of a user and reaches the end of its lifetime. Further, the cartridge P is urged downward by an unshown urging member entering the cartridge P side in interrelation with a closing operation of a door 10, thus being retained at a predetermined position inside the apparatus main assembly 100A.

The electrostatic transfer device 5 (electrostatic transfer means) transfers the toner image from the surface of the photosensitive drum 1 onto a recording material (medium) S. The electrostatic transfer device 5 includes a transfer belt 11 contactable to the photosensitive drum 1. The recording material S is conveyed to a transfer position by the transfer belt 11 and at the transfer position, the toner image is transferred from the photosensitive drum 1 onto the recording material S. The transfer rollers 12 are disposed in parallel inside the transfer belt 11 at positions in which the transfer rollers 12 opposes the photosensitive drums through the transfer belt 11. From each of these transfer rollers 12, positive electric charges are applied to the recording material S through the transfer belt 11. As a result, the toner image is transferred from the photosensitive drum 1 onto the recording material S.

The cleaning device 6 (cleaning means) removes the toner remaining on the surface of the photosensitive drum 1 after the transfer. Below the transfer belt 11 of the electrostatic transfer device 5, a cleaning device 7 for removing residual toner deposited on the transfer belt 11 is provided.

A feeding portion 16 feeds and conveys the recording material S to an image forming portion. A plurality of sheets of the recording material S is accommodated in a sheet feeding cassette 17. During image formation, a feeding roller 18 and a registration roller pair 19 are rotationally driven depending on an image forming operation. As a result, the sheets of the recording material S in the sheet feeding cassette 17 are separated and fed one by one. Then, in synchronism with the rotation of the transfer belt 11 and the toner image, the recording material S is conveyed to the transfer belt 11 by the registration roller pair 19.

A fixing device 20 (fixing means) fixes toner images of plural colors transferred onto the recording material S. The fixing device 20 includes a rotatable heating roller 21*a* and a pressing roller 21*b*, contactable to the heating roller 21*a*, for applying heat and pressure to the recording material S. The recording material S on which the toner image on the surface of the photosensitive drum 1 is transferred passes through the fixing device 20 while being conveyed between the heating roller 21*a* and the pressing roller 21*b*. The recording material S is supplied with heat and pressure by the heating roller 21*a* and the pressing roller 21*b*. As a result, the toner images of plural colors are fixed on the surface of the recording material S.

The image forming operation is as follows. First, the photosensitive drum 1 is driven rotationally. Then, the scanner unit 3 is driven. By this drive, the charging device 2 applies uniform electric charges to the circumferential surface of the photosensitive drum 1. Then, the surface of the photosensitive drum 1 is exposed light depending on the image signal by the scanner unit 3, so that the electrostatic image is formed on the surface of the photosensitive drum 1. The developing roller 40 develops the electrostatic image. As described above, on the recording material S, by an electric field generated between each photosensitive drum 1 and the associated transfer roller 12, the toner images are successively transferred from the respective photosensitive drums 1. The recording material S on which the four color toner images are transferred is conveyed into the fixing device 20. The recording material S is, after being subjected to heat fixing of the toner images, discharged from a discharge portion 24 to the outside of the apparatus main assembly 100A by a discharge roller pair 23.

Figure 1B:
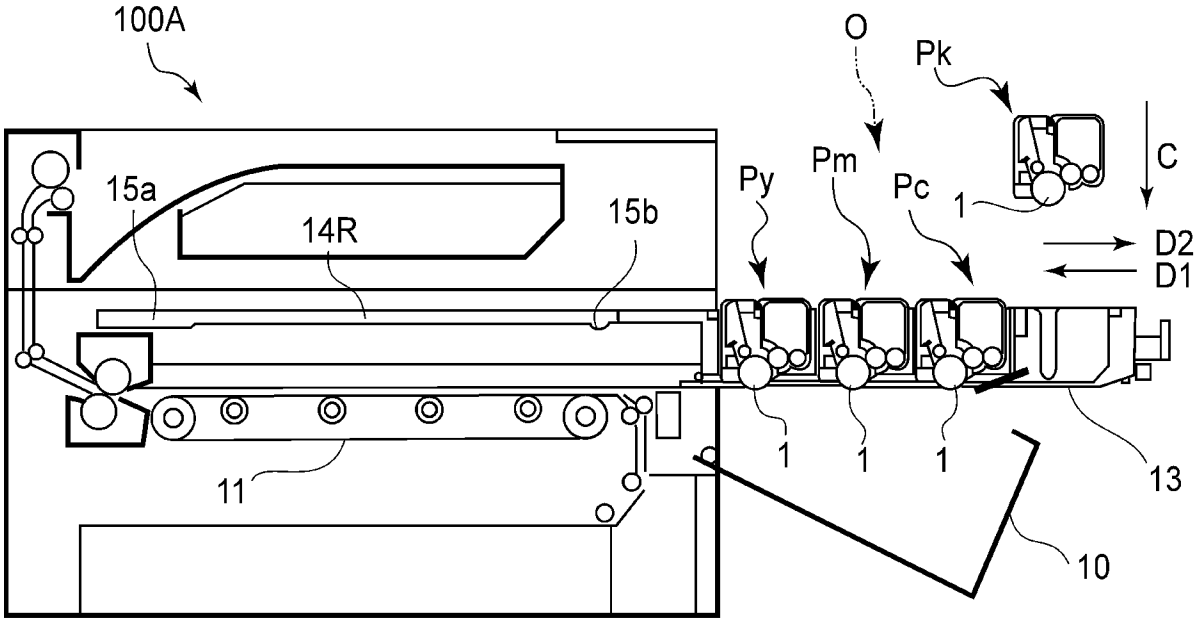
Figure 3A:
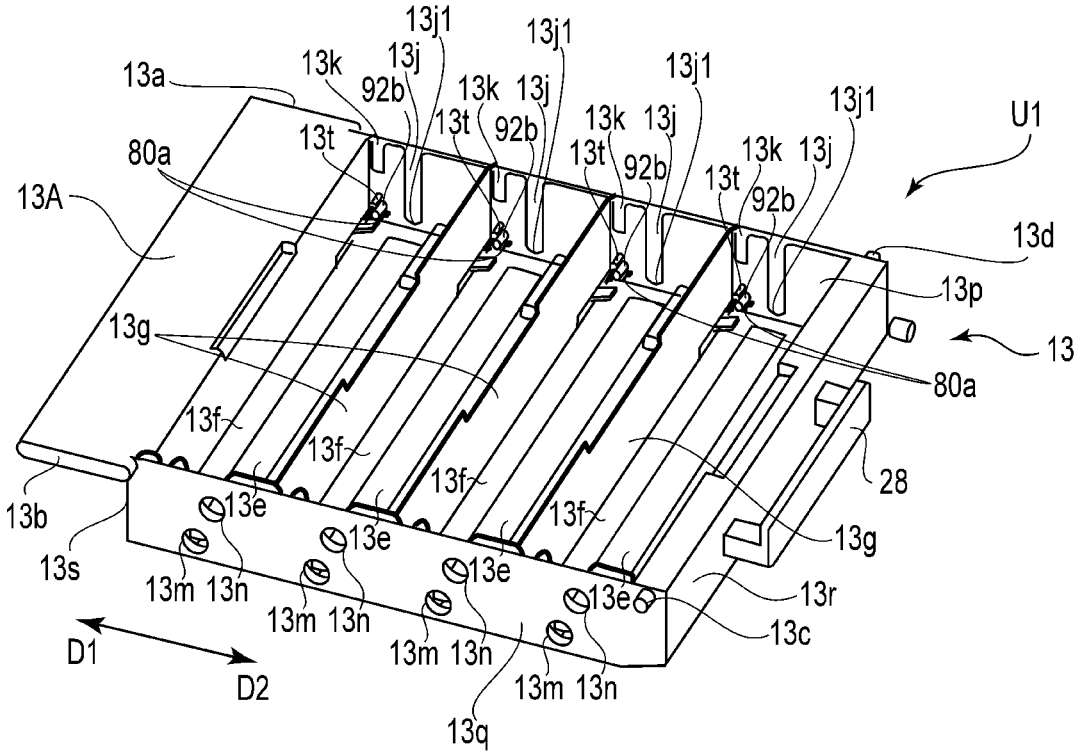
FIGS. 3A to 3D are perspective views showing a structure of a pulling-out unit.

FIG. 1B is a sectional view of the image forming apparatus 100 in a state in which the pulling-out member 13 is pulled out to an outside position O. As shown in FIG. 1B, the pulling-out member 13 is provided so that it can be pushed into the apparatus main assembly 100A in a pushing-in direction D1 directed horizontally leftward and can also be pulled out from the apparatus main assembly 100A in a pulling-out direction D2 directed horizontally rightward. The pulling-out member 13 is movable, in a state in which the cartridges position are mounted in mounting portions 13*f* shown in FIG. 3A, between an inside position I (FIG. 1A) which is an image forming position in which the pulling-out member 13 is inserted into the apparatus main assembly 100A and then an image is to be formed and an outside position O (FIG. 1B) which is a cartridge mounting position in which the cartridges P are mountable. The mounting portions 13*f* are provided at four positions as shown in FIG. 3A.

In a state in which the pulling-out member 13 is located at the pulled-out position, as shown in FIG. 1B, the cartridges P (Py, Pm, Pc and Pk) are mounted by a user into the mounting portions 13*f* in a gravitational direction indicated by an arrow C. The cartridges P are arranged side by side along a movement direction of the pulling-out member 13 so that a longitudinal direction of each cartridge P (an axial direction of the developing roller 40) is perpendicular to the movement direction of the pulling-out member 13. The cartridges P enter the inside of the apparatus main assembly 100A together with the pulling-out member 13 in a state in which the cartridges P are held in the pulling-out member 13. Therefore, the user can mount the cartridges P in the apparatus main assembly 100A with reliability by causing the pulling-out member 13 to enter the inside of the apparatus main assembly 100A and then by closing the door 10. For this reason, operativity is improved with respect to a constitution in which the cartridges P are individually mounted inside the apparatus main assembly 100A by the user.

Figure 2:
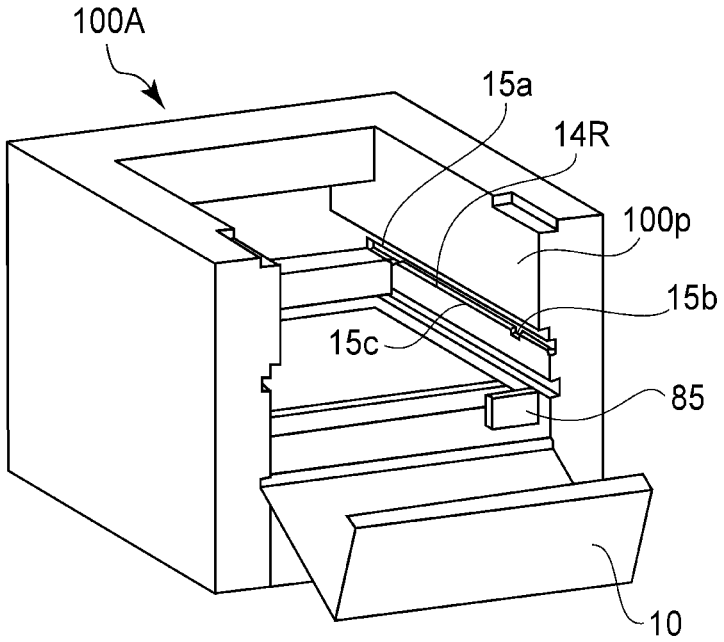
FIGS. 2(*a*) and 2(*b*) are perspective views showing an inside structure of an apparatus main assembly of the image forming apparatus.
Figure 2:
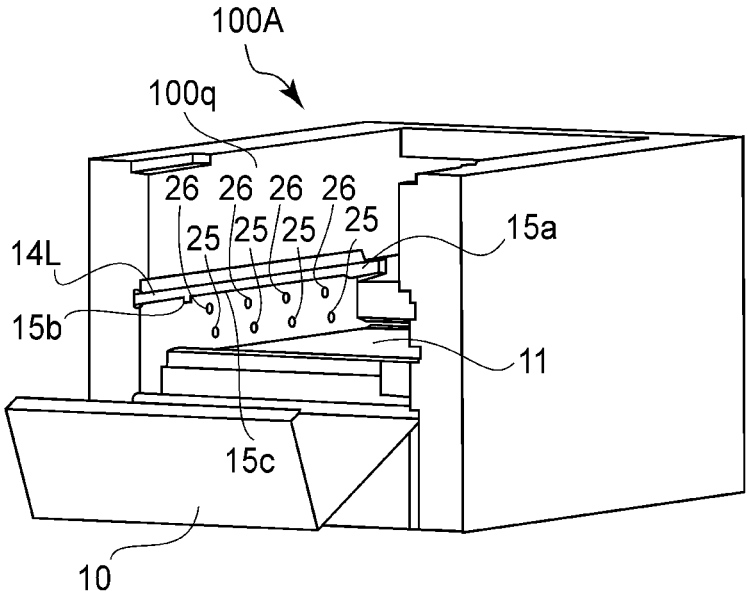

FIG. 2(*a*) is a perspective view showing a constitution of a first inner side surface 100*p* of the apparatus main assembly 100A. FIG. 2(*b*) is a perspective view showing a second inner side surface 100*q* of the apparatus main assembly 100A. In FIGS. 2(*a*) and 2(*b*), the scanner unit 3 and the like are omitted. As shown in FIGS. 2(*a*) and 2(*b*), the apparatus main assembly 100A is configured, in a state in which the door 10 is opened, to expose the first inner side surface 100*p* and the second inner side surface 100*q*. In the neighborhood of an entrance of the apparatus main assembly 100A, guide members 14R and 14L are provided for guiding the pulling-out member 13 between the outside position O (FIG. 1B) and the inside position I (FIG. 1A). Specifically, the guide member 14R is provided on the first inner side surface 100*p* (FIG. 2(*a*)), and the guide member 14L is provided on the second inner side surface 100*q* (FIG. 2(*b*)). The guide members 14R and 14L are disposed at mutually opposing positions.

The guide members 14R and 14L guide portions 13*a* to 13*d* to be guided (FIG. 3A), described later, of the pulling-out member 13 and each includes a guide portion 15*c* having a U-like cross section and extending in a substantially horizontal direction from a front side to a rear side of the apparatus main assembly 100A. The guide member 14R includes recessed portions 15*a* and 15*b* lower than the guide portion 15*c* by one stage. Similarly, the guide member 14L includes the recessed portions 15*a* and 15*b* lower than the guide portion 15*c* by one stage. For this reason, the portions 13*a* to 13*d* to be guided of the pulling-out member 13 are to be disposed at the inside position I while being engaged in the recessed portions 15*a* and 15*b*. As a result, the pulling-out member 13 is guided at the inside position I inside the apparatus main assembly 100A by the guide members 14R and 14L.

As shown in FIG. 2(*b*), below the guide member 14L, drum coupling members 25 for transmitting a driving force to the photosensitive drums 1 and developing device coupling members 26 for transmitting the driving force to the developing rollers 40 are horizontally disposed at regular intervals. Each of the drum coupling members 25 and the developing device coupling members 26 transmits the driving force from an unshown driving source to the associated cartridge P. The drum coupling member 25 and the developing device coupling member 26 are in a state in which they are retracted inside the second inner side surface 100*q* when the door 10 is closed. Further, these coupling members 25 and 26 are configured to enter the cartridge P side from the second side surface 100*q* in interrelation with the closing operation of the door 10. A preventing wall portion 85 as a portion to be prevented is fixed inside the apparatus main assembly 100 beside a movement path of the pulling-out member 13.

Figure 3B:
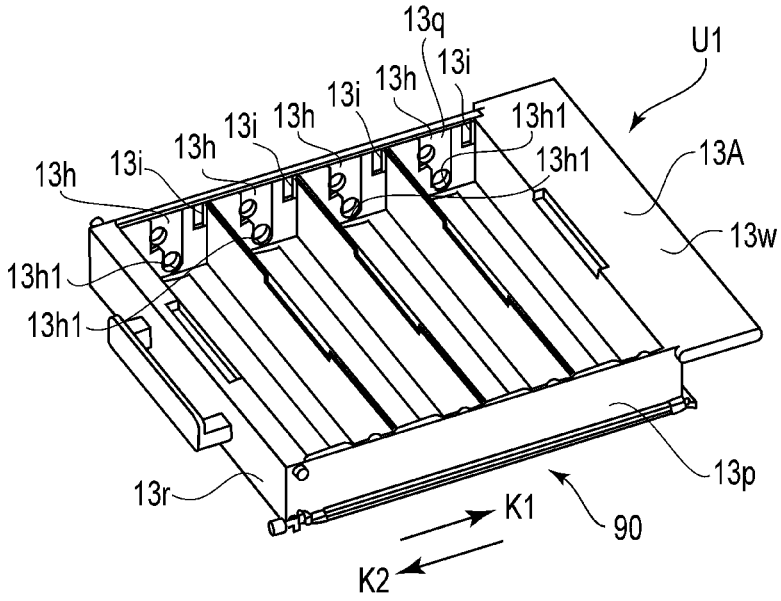
Figure 3C:
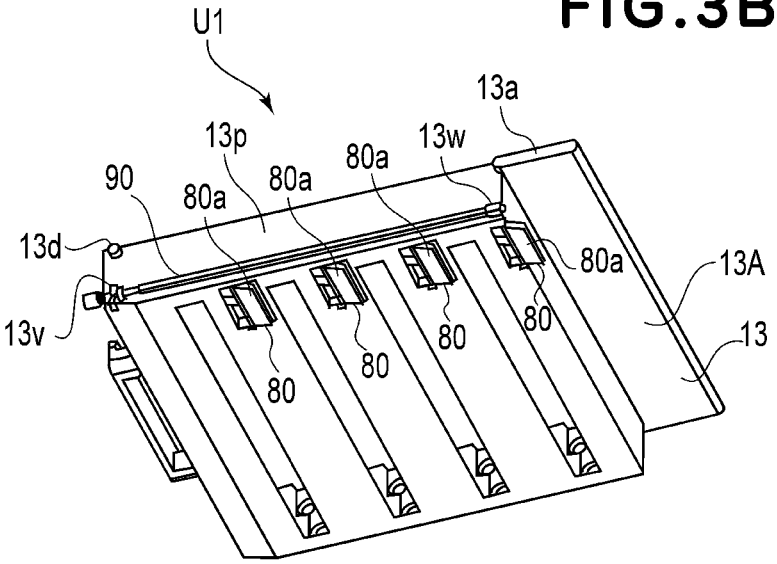

FIGS. 3A to 3D are perspective views showing a structure of a pulling-out unit U1. FIG. 3A is the perspective view of the pulling-out unit U1 as seen from above the unit U1 so that an inner side surface of a first side wall 13*p* and an outer side surface of a second side wall 13*q* can be seen. FIG. 3B is the perspective view of the unit U1 as seen from above the unit U1 so that an outer side surface of the first side wall 13*p* and an inner side surface of the second side wall 13*q* can be seen. Further, FIG. 3C is the perspective view of the unit U1 as seen from below the unit U1 so that the outer side surface of the first side wall 13*p* can be seen.

The pulling-out member 13 includes a front wall 13*r* on its front side and a rear wall 13*s* on its rear side. The front wall 13*r* is provided with a grip portion 28 for operating the pulling-out unit U1 by the user. The rear wall 13*s* is provided with a guide plate 13A having a plate surface extending in the horizontal direction. The first side wall 13*p* is provided with the portion to be guided 13*d* on the front wall 13*r* side, and the second side wall 13*q* is provided with the portion to be guided 13*c* on the front wall 13*r* side. Further, the guide plate 13A is provided with the portion to be guided 13*a* at end portion on the image side wall 13*p* side and is provided with the portion to be guided 13*b* at an end portion on the second side wall 13*q* side. The portions 13*a* and 13*d* to be guided are guided by the guide member 14R and the portions 13*b* and 13*c* to be guided are guided by the guide member 14L. The portions 13*a* and 13*b* are provided so as to extend in the pushing-in direction D1 so that the pulling-out member 13 is not inclined at the outside position O and have a outwardly projected shape with respect to a widthwise direction perpendicular to the pushing-in direction D1 and the pulling-out direction D2. Further, the portions 13*c* and 13*d* have a cylindrical shape and are outwardly projected with respect to the widthwise direction perpendicular to the pushing-in direction D1 and the pulling-out direction D2 similarly as in the case of the portions 13*a* and 13*b*.

The pulling-out member as the cartridge supporting member includes the mounting portions 13*f* which are cartridge mounting portions in which the cartridges P are to be mounted. The mounting portions 13*f* are provided in series so that the cartridges P described later are mountable side by side. The mounting portions 13*f* are partitioned by partition plates 13*q* which are rough indication at the time of mounting the cartridges P. At a lower portion of each of the mounting portions 13*f*, an opening 13*e* is provided. Through the opening 13*e*, the photosensitive drum 1 provided in the cartridge P can contact the transfer belt 11.

As shown in FIG. 3B, at an end portion of each mounting portion 13*f*, guide portions 13*h* and 13*i* for permitting mounting of the cartridge P inside the pulling-out member 13. Similarly, as shown in FIG. 3A, on an opposite side of the pulling-out member 13, guide portions 13*j* and 13*k* are provided. Below the guide portions 13*h* and 13*j*, positioning portions 13*h*1 and 13*j*1 for permitting developing of the cartridge P relative to the pulling-out member are provided.

Figure 13:
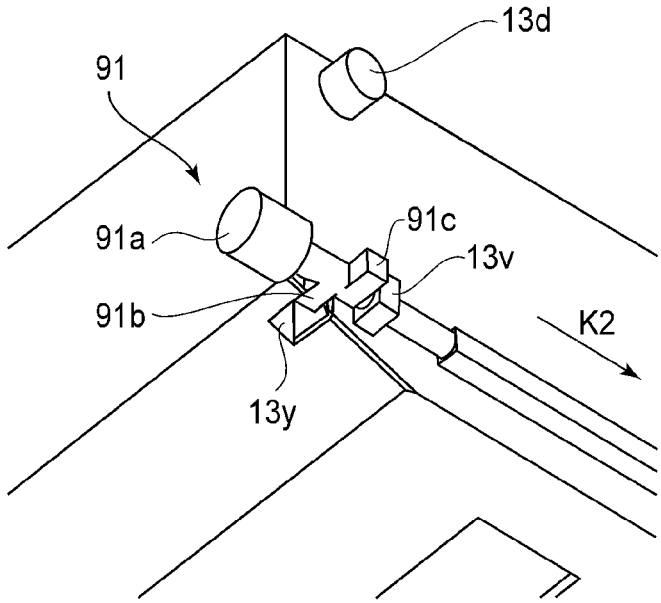
FIGS. 13(*a*) and 13(*b*) are perspective views showing a mechanism for retaining the releasing operation member at a sliding position.
Figure 13:
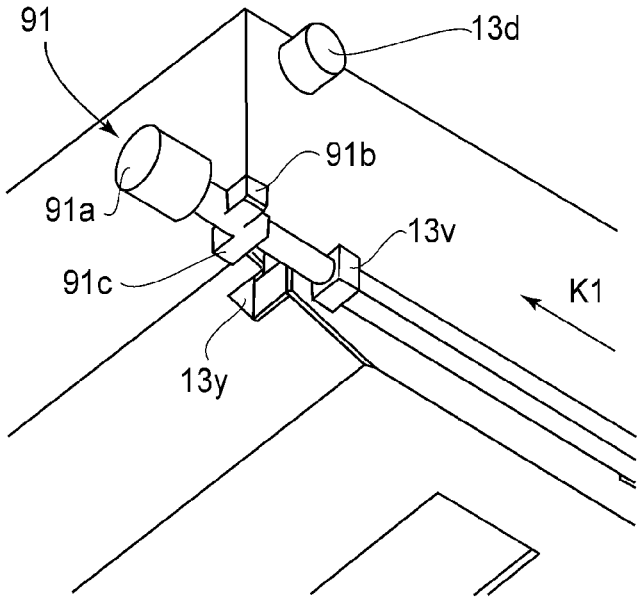

As shown in FIG. 13(*a*), the pulling-out member 13 is provided with an opening 13*n* through which the above-described drum coupling member 25 can enter the pulling-out member 13 and is provided with an opening 13*m* through which the developing device coupling member 26 can enter the pulling-out member 13. The drum coupling member 25 and the developing device coupling member 26 enter the openings 13*n* and 13*m* in interrelation with the closing operation of the door 10. Thereafter, the coupling members 25 and 26 engage with coupling members of the cartridge P to transmit the driving force to the cartridge P as described later.

As shown in FIG. 3C, at a lower portion of the pulling-out member 13, four stoppers 80 as a preventing member are provided. Each of the stoppers 80 is rotatably and movably provided in the pulling-out member 13 and is retained at a position (first position) in which a stopper portion 80*a* is projected from a bottom surface of the pulling-out member 13 by being urged by a helical coil spring 81 (FIG. 3D) as an urging member. An operation and function of the stopper 80 when the cartridge P is mounted in the pulling-out member 13 will be described more specifically later.

As shown in FIGS. 3B and 3C, the pulling-out member 13 is provided with a releasing operation member 90 (second releasing means) on the side surface thereof. The releasing operation member 90 is slidably provided on the pulling-out member 13 with respect to directions indicated by arrows K1 and K2. When the releasing operation member 90 is slid in the direction of the arrow K2, the four stoppers 80 are rotationally moved and positioned in a state in which the stoppers 80 and projected from the bottom surface of the pulling-out member 13. Incidentally, in FIGS. 3B and 3C, the releasing operation member 90 is slid in the direction of the arrow K1 and details thereof such as its function will be described later. The pulling-out unit U1 is constituted by the pulling-out member 13, the stoppers 80 and the releasing operation member 90.

Figure 4:
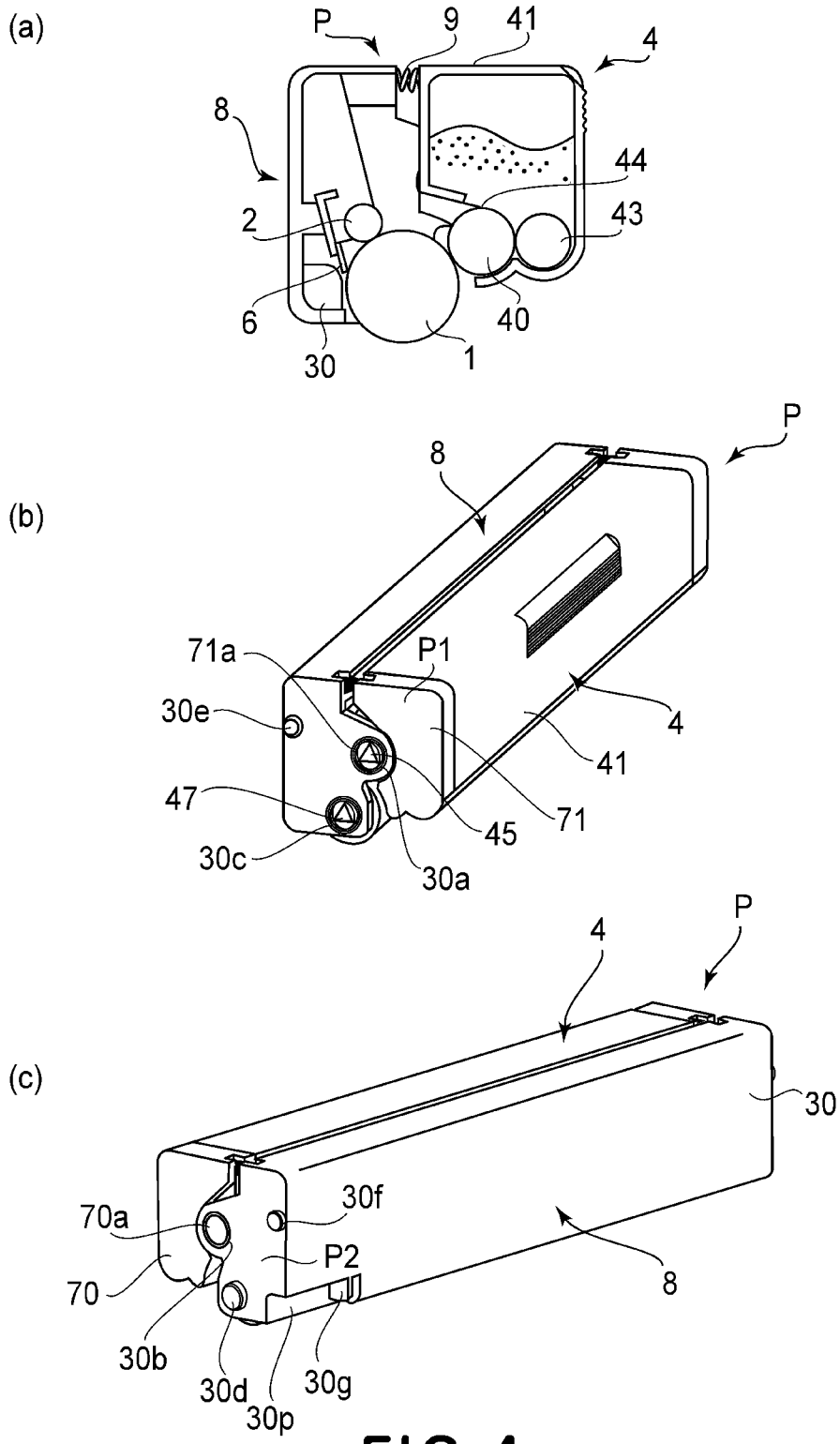
FIGS. 4(*a*) to 4(*c*) are sectional and perspective views showing a cartridge.

FIG. 4(*a*) is a sectional view of the cartridge P. FIG. 4(*b*) is a perspective view of the cartridge P as seen from a direction in which a first side surface P1 can be seen. FIG. 4(*c*) is a sectional view of the cartridge P as seen from a direction in which a second side surface P2 can be seen. The cartridge P includes a toner container 41 which is a developer accommodating portion for accommodating the developer and is mountable into and demountable from the apparatus main assembly 100A. In this embodiment, the four cartridges P accommodating toners of colors different from each other are used. As shown in FIG. 4(*a*), the cartridge P is constituted by integrally supporting a photosensitive member unit 8 and a developing unit 4. The photosensitive member unit 8 includes the photosensitive drum 1, the charging device 2, the cleaning device 6, and a residual toner container 30 for containing the toner removed by the cleaning device 6. The developing unit 4 includes the developing roller 40, the toner feeding roller 43, the developing blade 44, and the toner container 41 accommodating the toner used for image formation.

The toner inside the toner container 41 is fed to the toner feeding roller 43. By the toner feeding roller 43 and the developing blade 44 urged against the outer circumferential surface of the developing roller 40, the toner is applied onto the outer circumferential surface of the developing roller 40. To the toner, electric charges are applied to the developing blade 44. By applying a developing bias from the apparatus main assembly 100A to the developing roller 40, the electrostatic image formed on the photosensitive drum 1 is developed. After the toner image developed formed on the photosensitive drum 1 is transferred onto the recording material S, the toner remaining on the surface of the photosensitive drum 1 is removed by the cleaning device 6 and is collected in the residual toner container 30. When the toner inside the toner container 41 is consumed, the user exchanges the cartridge P and then effects image formation again.

As shown in FIG. 4(*b*), on the first side surface P1 of the cartridge P, a coupling member 47 for receiving the driving force from the drum coupling member 25 on the apparatus main assembly 100A side is supported rotatably. Further, on the first side surface P1 of the cartridge P, a coupling member 45 for receiving the driving force from the developing device coupling member 26 (FIG. 2(*b*)). The coupling member 47 is provided at one end of the photosensitive drum 1, and the driving force received by the coupling member 47 from the apparatus main assembly 100A rotates the photosensitive drum 1. The driving force received by the coupling member 45 is transmitted to the developing roller 40 and the toner feeding roller 43 through intermediate gears (not shown). The coupling member 45 is covered with a rib at its outer circumferential surface, so that an engaging portion 71*a* is created. The engaging portion 71*a* is provided on a side cover 71 fixed outside the toner container 41. The coupling member 45 is rotatable relative to the engaging portion 71*a*.

Further, as shown in FIG. 4(*c*), on the second side surface P2 of the cartridge P, an engaging portion 70*a* is provided opposite from the engaging portion 71*a* described above. The engaging portion 70*a* is similarly provided on the side cover 70. Both of the engaging portions 71*a* and 70*a* are provided on the developing unit 4.

Further, as shown in FIGS. 4(*b*) and 4(*c*), the residual toner container 30 is provided with holes 30*a* and 30*b* for supporting the engaging portions 71*a* and 70*a*. In the holes 30*a* and 30*b* provided on the residual toner container 30, the engaging portions 71*a* and 70*b* provided on the developing unit 4 are engaged, so that the photosensitive member unit 8 and the developing unit 4 are connected with each other. Here, the engaging portions 71*a* and 70*a* are movable (rotatable) relative to the holes 30*a* and 30*b*, respectively. For that reason, the developing unit 4 is movable relative to the photosensitive member unit 8. That is, the developing roller 40 can be moved relative to the photosensitive drum 1. As shown in FIG. 4(*a*), between the photosensitive member unit 8 and the developing unit 4, a spring 9 as an urging member is provided and urges the developing roller 40 against the photosensitive drum 1 with a predetermined urging force.

As shown in FIG. 4(*b*), the outer circumferential surface of the coupling member 47 is covered with a cylindrical rib to create a portion to be guided 30*c*. Further, as shown in FIG. 4(*c*), on a longitudinal opposite side of the coupling member 47, a cylindrical projection is projected to create a portion to be guided 30*d*. Further, as shown in FIG. 4(*b*), above the portion to be guided 30*c*, a portion to be guided 30*e* is provided. Similarly, above the portion to be guided 30*d*, as shown in FIG. 4(*c*), a portion to be guided 30*f* is provided. The portions 30*c*, 30*d*, 30*e* and 30*f* have the function that the cartridge P is mounted and positioned in the pulling-out member 13.

Further, as shown in FIG. 4(*c*), the residual toner container 30 is provided with a recessed portion 30*p* at a longitudinal front end portion. The recessed portion 30*p* is provided with a rib 30*g* (contact portion) which is a first releasing means for releasing movement prevention of the pulling-out member 13 by the preventing wall portion 85 and the stopper portion 80*a* shown in FIG. 11(*a*) when the cartridge P is mounted in the pulling-out member 13. A longitudinal position of the rib 30*g* is different for each of the cartridges P for the respective colors. These ribs 30*g* of the cartridges P are provided correspondingly to the associated mounting portions 13*f*, respectively.

Figure 5:
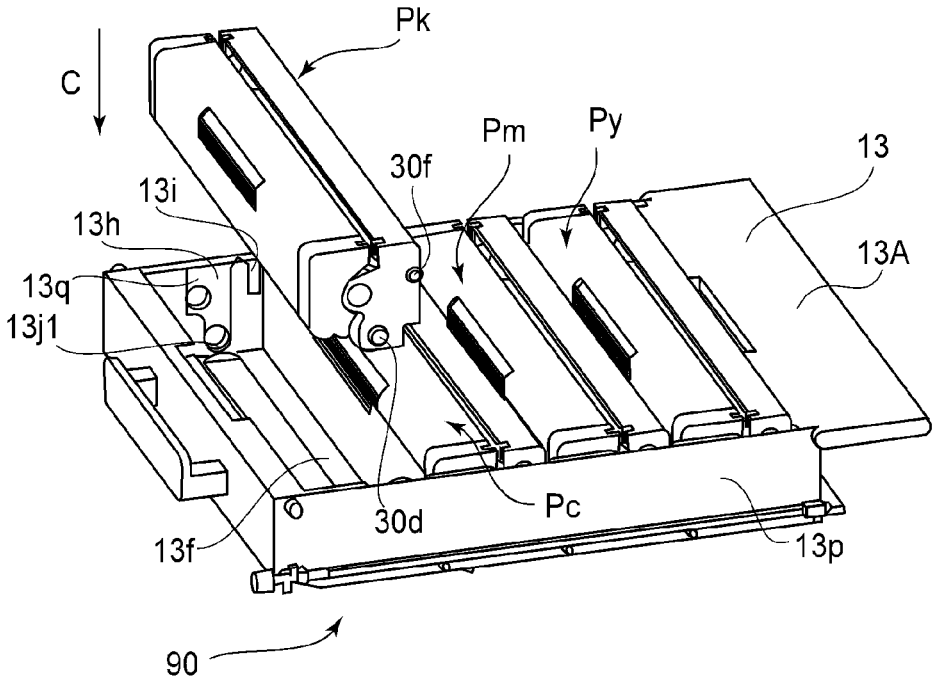
FIGS. 5(*a*) and 5(*b*) are perspective views for illustrating a step of mounting the cartridge in a pulling-out member.
Figure 5:
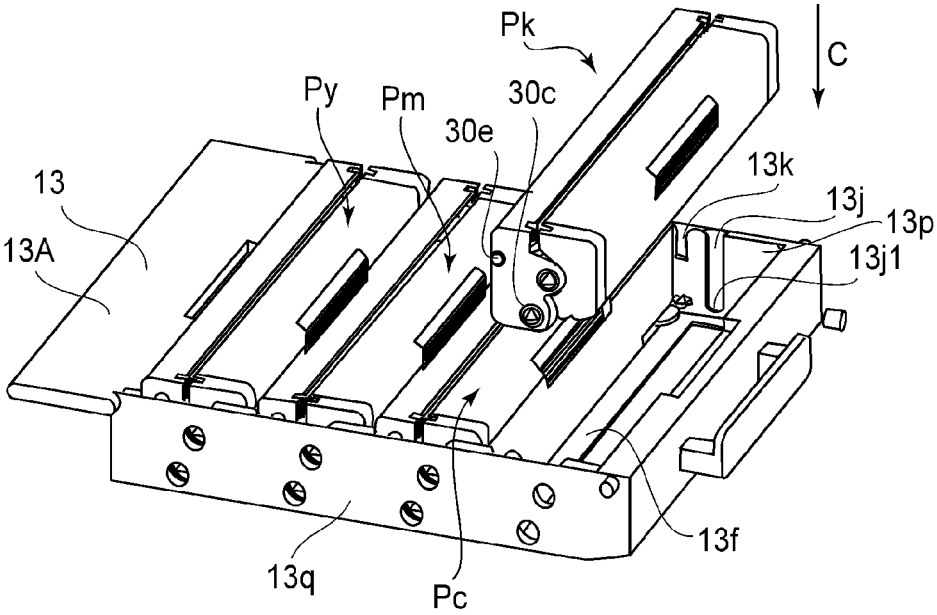

FIG. 5(*a*) is a perspective view showing a step of mounting the cartridge P (Pk) in the pulling-out member 13. In FIG. 5(*a*), the pulling-out member 13 is shown so that the outer surface of the first side wall 13*p* can be seen as the front side. On the other hand, in FIG. 5(*b*), the pulling-out member 13 is shown so that the second side wall 15*q* can be seen as the front side. The cartridge P is mounted in the associated mounting portion 13*f* provided in the pulling-out member 13 (FIGS. 5(*a*) and 5(*b*)). The user mounts the cartridge P in the mounting portion 13*f* in the direction of the arrow C which is a substantially gravitational direction.

As shown in FIGS. 5A and 5B, first, the portions 30*c* and 30*d* to be guided which are provided at the end portions of the cartridge P are mounted in the mounting portion 13*f* correspondingly to the associated guide portions 13*h* and 13*j* of the pulling-out member 13. Then, the portions 30*e* and 30*f* are mounted correspondingly to the guide portions 13*i* and 13*k*. Thus, the cartridge P is mounted in the pulling-out member 13 by being guided by the guide portions 13*h*, 13*i*, 13*j* and 13*k*.

Figure 6:
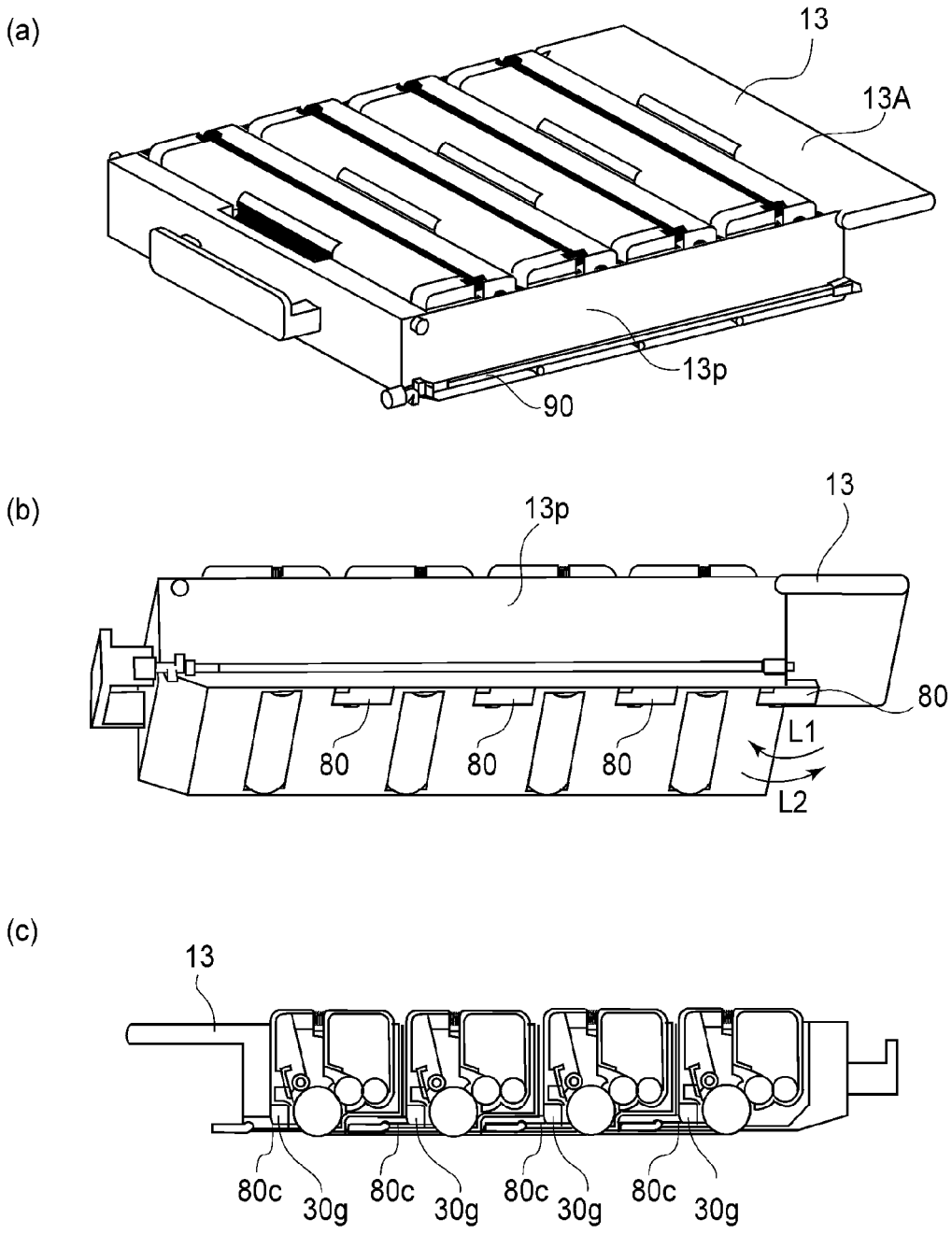
FIGS. 6(*a*) to 6(*c*) are perspective and sectional views showing a state in which the mounting of the cartridges in the pulling-out member is completed.

FIGS. 6(*a*) and 6(*b*) are perspective views showing a state in which the mounting of the cartridge P in the pulling-out member 13 is completed. FIG. 6(*a*) is the perspective view as seen from obliquely above the pulling-out member 13. FIG. 6(*b*) is the perspective view as seen from obliquely below the pulling-out member 13. FIG. 6(*c*) is a sectional view of the pulling-out member 13 shown in FIGS. 6(*a*) and 6(*b*). When the mounting of the cartridges P in the pulling-out member 13 is completed, as shown in FIGS. 6(*a*) and 6(*b*), the stoppers 80 are placed in a state in which the cartridge P for the respective colors are mounted in the pulling-out member 13. The positions of the stoppers 80 are a second position. When predetermined cartridges P are mounted in the mounting portions 13*f*, as shown in FIG. 6(*b*), all the stoppers 80 are located above the bottom surface of the pulling-out member 13. This is because, as shown in FIG. 6(*c*), the ribs 30*g* provided at the recessed portions of the cartridges P contact portions 80*c* to be contacted of the stoppers 80 and rotationally move the stoppers 80 in a direction indicated by an arrow L2 (FIG. 6(*b*)). When the cartridges P are mounted in the pulling-out member 13, the ribs 30*g* cannot contact the portions 80*c* to be contacted of the stoppers 80, so that the stoppers 80 are projected downward from the bottom surface of the preventing member 13.

Figure 7:
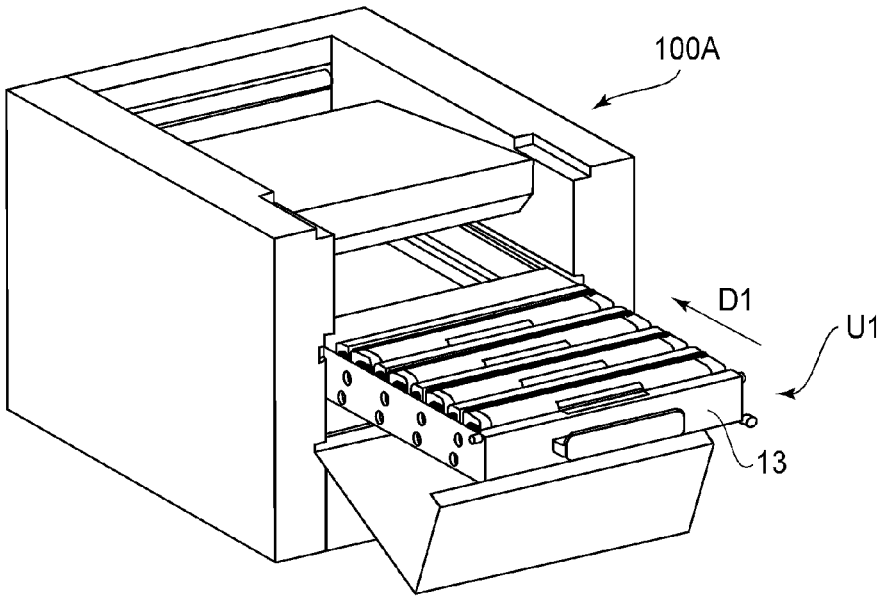
FIGS. 7(*a*) and 7(*b*) are a perspective view and a sectional view which show a step of mounting the pulling-out member into the apparatus main assembly.
Figure 7:
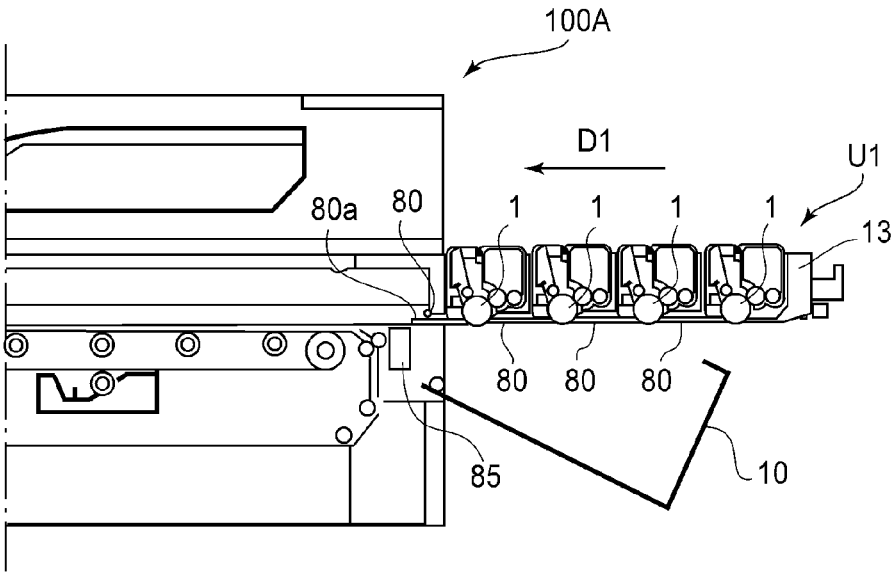
Figure 17:
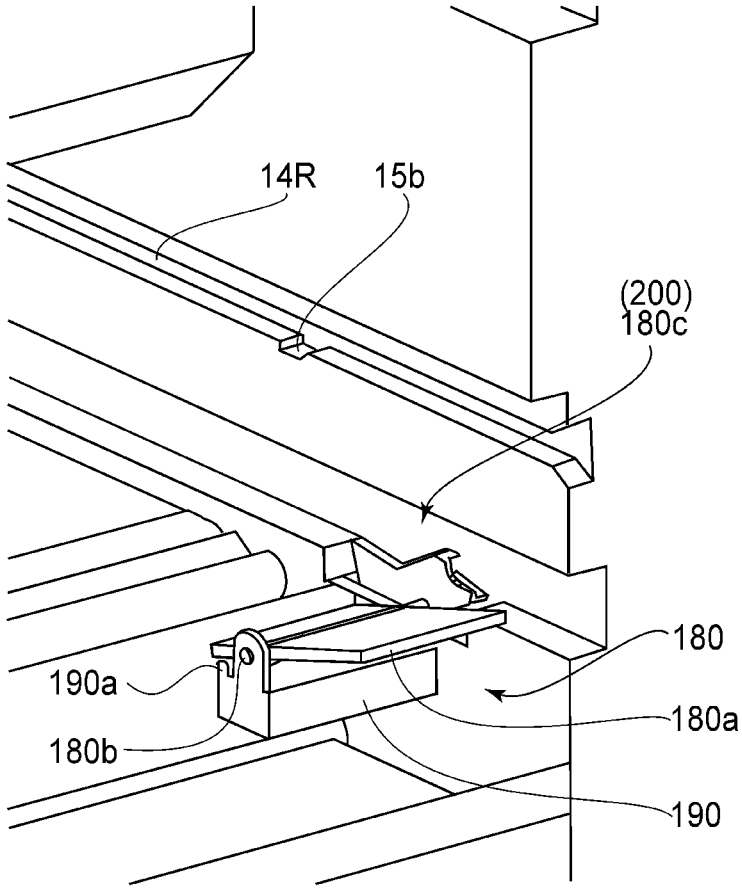
FIGS. 17(*a*) and 17(*b*) are perspective views showing a structure of a stopper provided in an apparatus main assembly.
Figure 17:
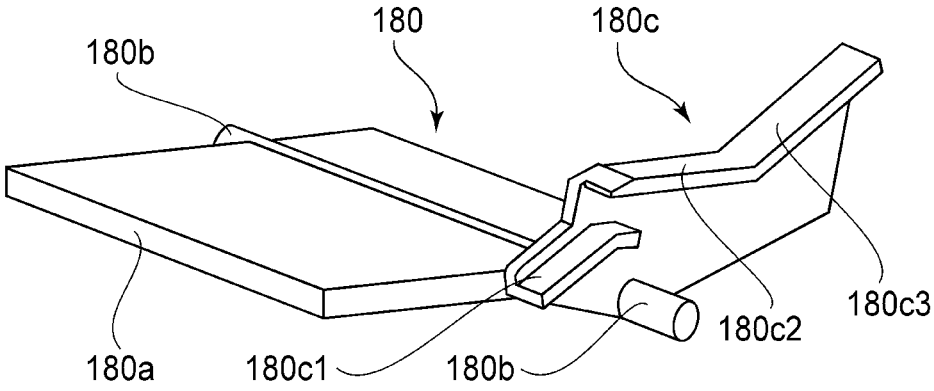

FIG. 17(*a*) is a perspective view showing a step of mounting the pulling-out member 13 into the apparatus main assembly 100A. As shown in FIG. 7(*a*), the portions 13*a* to 13*d* to be guided which are provided on the pulling-out member 13 (FIGS. 5(*a*) and 5(*b*)) are guided by the guide members 14R and 14L and are moved in the pushing-in direction D1, so that the pulling-out member 13 is mounted into the apparatus main assembly 100A.

Figure 8:
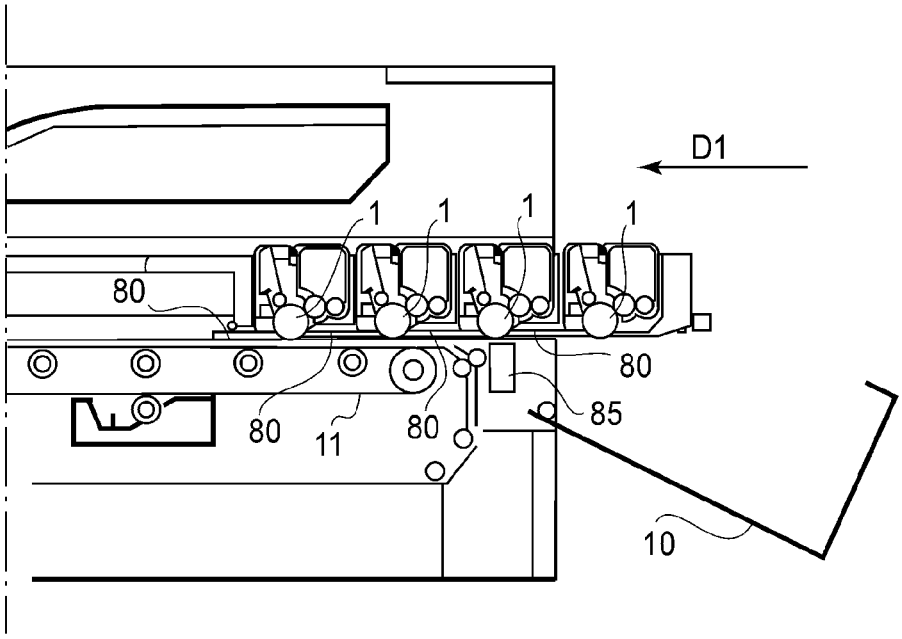
FIGS. 8(*a*) and 8(*b*) are sectional views showing the step of mounting the pulling-out member into the apparatus main assembly.
Figure 8:
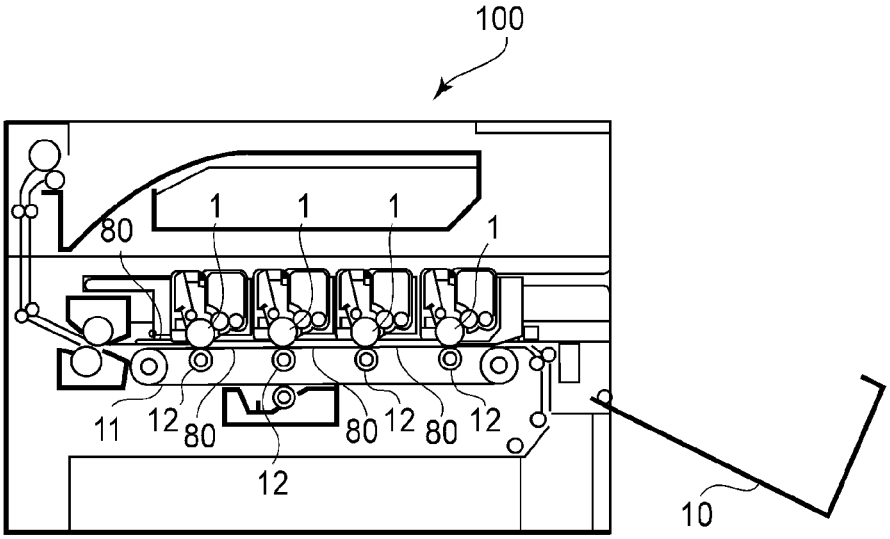

FIG. 7(*b*) is a sectional view showing the step of mounting the pulling-out member 13 into the apparatus main assembly 100A. FIG. 8(*a*) is a sectional view also showing the step of mounting the pulling-out member 13 into the apparatus main assembly 100A. Referring to FIG. 7(*b*), the respective stoppers 80 are located above the bottom surface of the pulling-out member 13 and thus do not interfere with the preventing wall portion 85 (FIG. 2(*a*)), so that the pulling-out member 13 is mounted into the apparatus main assembly 100A. Further, the guide members 14R and 14L (FIGS. 2(*a*) and 2(*b*)) are located at positions higher than the recessed portions 15*a* and 15*b* by one stage. For that reason, during the mounting operation of the pulling-out member 13, as shown in FIG. 8(*a*), the surfaces of the photosensitive drums 1 accommodated in the pulling-out member 13 are retained in a state in which they are spaced from the preventing wall portion 85 and a recording material conveying surface of the transfer belt 11. Therefore, the pulling-out member 13 can be inserted into the apparatus main assembly 100A with no contact of the surfaces of the photosensitive drums 1 with the preventing wall portion 85 and with no friction of the surfaces of the photosensitive drums 1 with the surface of the transfer belt 11. At this time, the pulling-out member 13 is inserted substantially in parallel with the recording material conveying surface of the transfer belt 11. However, as described later, in the case where a cartridge different from the predetermined cartridge P is mounted in the pulling-out member 13, the stopper portion 80*a* projected downwardly from the bottom surface of the pulling-out member 13 contacts the preventing wall portion 85.

FIG. 8(*b*) is a sectional view showing a state in which the pulling-out member 13 is completely inserted in the apparatus main assembly 100A. As shown in FIG. 8(*b*), in the state in which the mounting of the pulling-out member 13 in the apparatus main assembly 100A is completed, the portions 13*a* to 13*d* to be guided of the pulling-out member 13 (FIGS. 5(*a*) and 5(*b*)) are engaged into the recessed portions 15*a* and 15*b* of the guide members 14R and 14L (FIGS. 2(*a*) and 2(*b*)). Then, the position of the pulling-out member 13 in the apparatus main assembly 100A is lowered, so that the surfaces of the photosensitive drums 1 contact the surface of the transfer belt 11. Thereafter, when the door 10 is closed, each cartridge p is urged by the above-described unshown urging member, so that the position of each cartridge p is retained inside the apparatus main assembly 100A. As described above, the pulling-out member 13 is mounted in the apparatus main assembly 100A. Further, by the action of the urging member, each cartridge P is positioned inside the apparatus main assembly 100A.

Figure 3D:
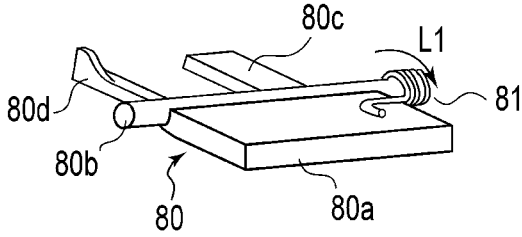
Figure 9:
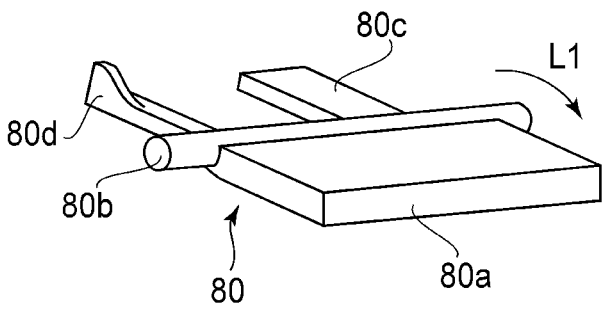
FIGS. 9(*a*) to 9(*c*) are perspective views showing a structure of a stopper.
Figure 9:
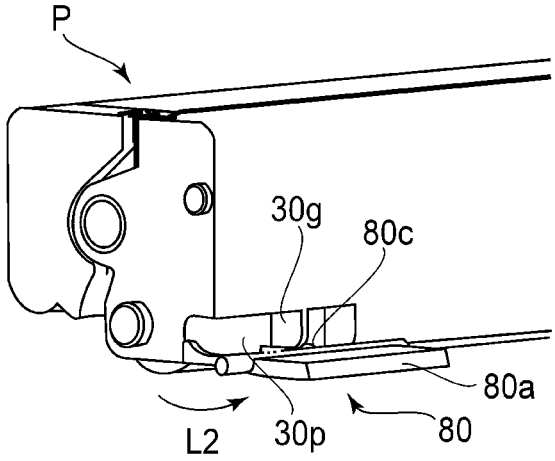
Figure 9:
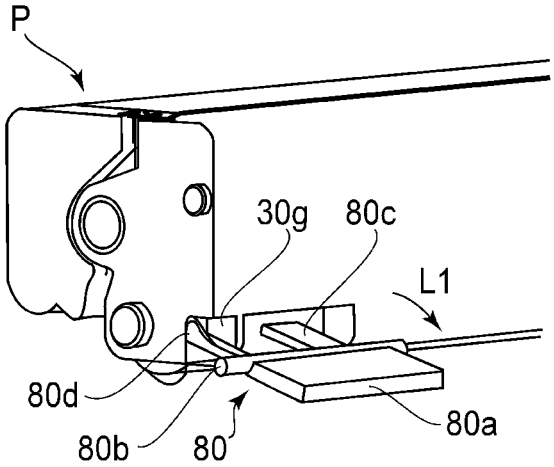
Figure 12:
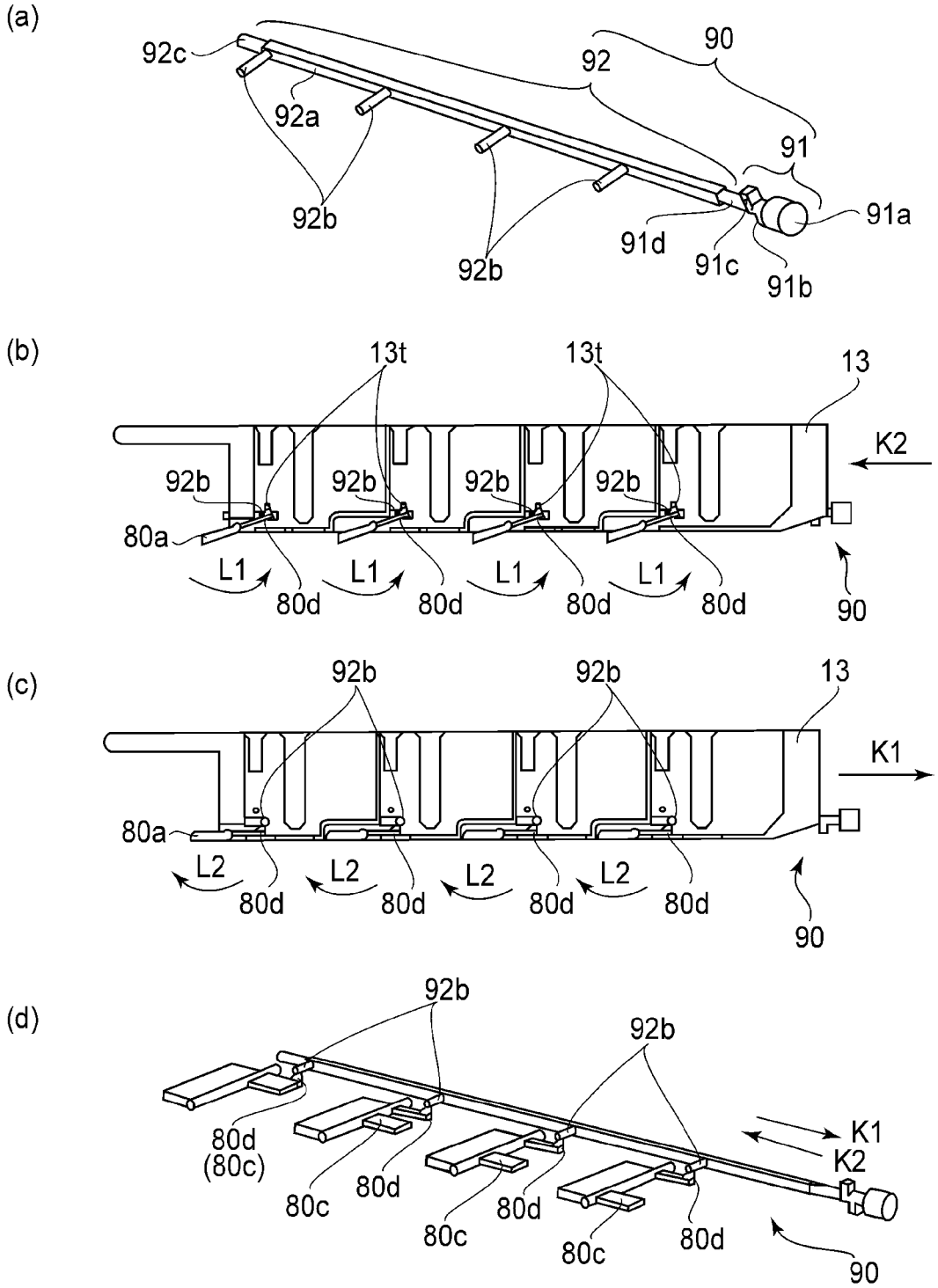
FIGS. 12(*a*) to 12(*d*) are perspective views showing a structure of a releasing operation member.

FIG. 9(*a*) is a perspective view showing a structure of the stopper 80. As shown in FIG. 9(*a*), the stopper 80 includes a portion to be supported 80*b*, the stopper portion 80*a*, a portion to be contacted 80*c*, and a rotation stopping contact portion 80*d*. The stopper portion 80*a* is provided, on the pulling-out member 13, rotatably about the portion to be supported 80*b*. Further, the stopper portion 80*a* is urged in the direction indicated by an arrow L1, by the helical coil spring 81 (FIG. 3D). As a result, a stopper stopping member 13*t* of the pulling-out member 13 and the rotation stopping contact portion 80*d* contact each other, so that the stopper portion 80*a* is retained at a rotational position shown in FIG. 9(*a*). Incidentally, the stopper stopping member 13*t* is shown in FIG. 3A and FIG. 12(*b*) and is a bar-like projection projected from the inner surface side of the first side wall 13*p*.

FIG. 9(*b*) is a perspective view showing a state in which an end of the stopper portion 80*a* is located at a raised position by urging the portion to be contacted 80*c* with the rib 30*g*. FIG. 9(*c*) is a perspective view showing a state in which the end of the stopper portion 80*a* is located at a lowered position without urging the portion to be contacted 80*c* with the rib 30*g*. As shown in FIGS. 9(*b*) and 9(*c*), the recessed portion 30*p* is provided at one end portion of the residual toner container 30 of the cartridge P, and the rib 30*g* is formed at the recessed portion 30*p*. Here, when the cartridge P is lowered, the cartridge P contacts the portion to be contacted 80*c* to push down the portion to be contacted 80*c*, so that the stopper portion 80*a* is rotated in the direction of the arrow L2. Then, the plate surface of the stopper portion 80*a* is directed in a direction along the horizontal direction (second attitude). On the other hand, when the cartridge P is raised, the cartridge P is separated from the portion to be contacted 80*c* to raise the portion to be contacted 80*c*, so that the stopper portion 80*a* is rotated in the direction of the arrow L1. Then, the plate surface of the stopper portion 80*a* is tilted in a state in which the plate surface forms a predetermined angle with respect to the horizontal surface (first attitude).

The stopper portion 80*a* shown in FIGS. 9(*b*) and 9(*c*) is provided on the pulling-out member 13. The stopper portion 80*a* is located at the lowered position (first position) in which the end of the stopper portion 80*a* is moved toward the movement path of the pulling-out member 13 to take the first attitude in the case where the cartridge P associated with the mounting portion 13*f* is not mounted. Herein, the case where the cartridge P associated with the mounting portion 13*f* (unmounting) includes both of the case where the cartridge different from the associated (predetermined) cartridge P is mounted and the case where the associated cartridge P is not mounted. Further, the stopper portion 80*a* is located at the raised position (second position) in which the end of the stopper portion 80*a* is retracted from the movement path of the pulling-out member 13 to take the second attitude in the case where the cartridge P associated with the mounting portion 13*f* is mounted. Incidentally, the above-described preventing wall portion 85 (portion to be prevented) contacts the stopper 80, which takes the first attitude, to prevent the movement of the pulling-out member 13. Thus, the preventing wall portion 85 and the stopper 80 constitute a member for preventing the movement of the pulling-out member 13 from the outside portion 0 to the inside portion I. Each stopper portion 80*a* is provided correspondingly to associated one of the plurality of mounting portions 13*f*. The movement of the pulling-out member 13 is prevented by the contact of the preventing wall portion 85 with the stopper portion 80*a*. That is, the pulling-out member 13 is prevented from moving from the outside portion 0 to the inside portion I by the stopper portion 80*a* and the preventing wall portion 85. As described above, the stopper portion 80*a* takes the first attitude by being urged by the urging member and takes the second attitude by being pressed by the cartridge P.

The portion to be contacted 80*c* is provided as a part of the stopper 80 attached to the pulling-out member 13 (FIG. 3B) and takes the second attitude by the contact with the rib 30*g*, so that the portion to be contacted 80*c* permits the movement of the pulling-out member 13 from the outside portion 0 to the inside portion I. The first releasing means is constituted by the rib 30*g* formed at a predetermined position of the cartridge P and the portion to be contacted 80*c* extending from the stopper portion 80*a* and contactable to the rib 30*g* by the rotational movement, which are associated with each other with respect to the longitudinal direction of the cartridge P.

Figure 10:
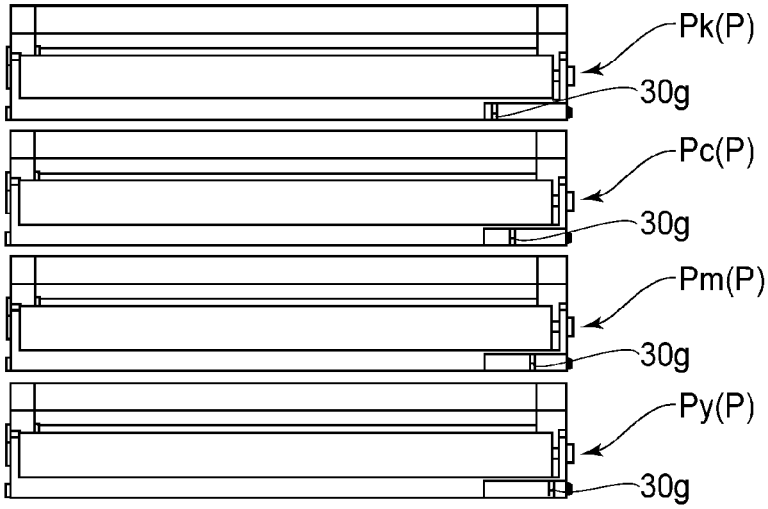
FIGS. 10(*a*) and 10(*b*) are rear views showing a structure of the pulling-out member in which the cartridges are mounted.
Figure 10:
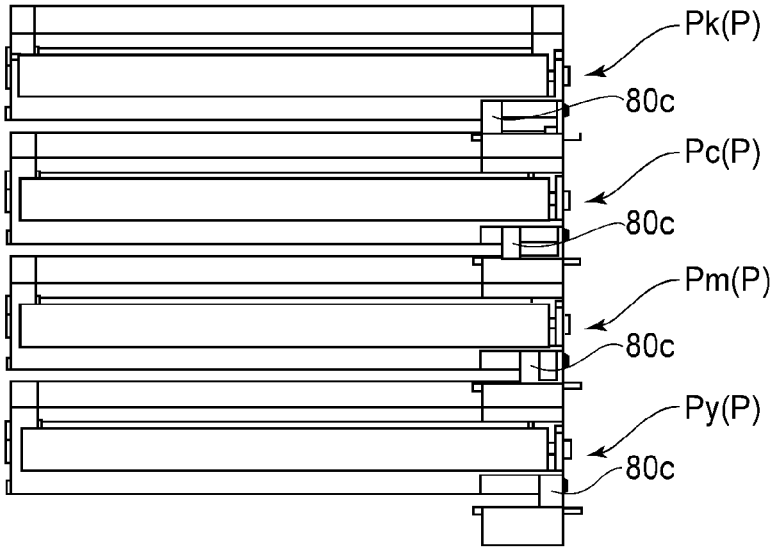

FIG. 10(*a*) is a rear view showing a structure of the pulling-out member 13 in which the respective cartridges P are mounted. FIG. 10(*a*) shows the structure of the pulling-out member 13 in a state in which the stoppers 80 are disconnected. As shown in FIG. 10(*a*), the ribs 30*g* are provided on the associated ones of the cartridges P. Further, the ribs 30*g* are provided at different positions every cartridge P with respect to the longitudinal direction of the cartridges P. The longitudinal direction of the cartridges P means a direction crossing the movement direction of the pulling-out member 13.

FIG. 10(*b*) is a rear view showing a structure of the pulling-out member 13 in which the cartridges P are mounted. As shown in FIG. 10(*b*), the portions to be contacted 80*c* of the stoppers 80 are also provided at different positions every associated mounting portion 13*f* with respect to the longitudinal direction of the cartridges P. By employing such a constitution, in the case where each of the predetermined cartridges P is mounted in the associated mounting portion 13*f* of the pulling-out member 13, the longitudinal positions of the associated portion to be contacted 80*c* of the stopper 80 and the associated rib 30*g* of the cartridge P coincide with each other.

As shown in FIG. 9(*b*), when the predetermined cartridge P is mounted in the mounting portion 13*f* of the pulling-out member 13, the rib 30*g* of the cartridge P contacts the portion to be contacted 80*c* of the stopper 80 to rotate the stopper 80 in the direction of the arrow L2. The rotated stopper 80 is located at the position higher than the bottom surface of the pulling-out member 13, so that the action of the stopper 80 is released (FIGS. 6(*b*) and 6(*c*)).

However, in the case where the cartridge P different from the predetermined cartridge P is mounted in the mounting portion 13*f* of the pulling-out member 13, the longitudinal positions of the rib 30*g* provided on the cartridge P and the portion to be contacted 80*c* of the stopper 80 do not coincide with each other, so that the rib 30*g* and the portion to be contacted 80*c* do not contact each other as shown in FIG. 9(*c*). In this case, the stopper portion 80*a* of the stopper 80 projects toward a lower side than the bottom surface of the pulling-out member 13 and the surface of the photosensitive drum 1 mounted in the pulling-out member 13.

Thus, the case where the mounting operation of the pulling-out member 13 into the apparatus main assembly 100A in the state in which the cartridge P different from the predetermined cartridge P is mounted in the mounting portion 13*f* of the pulling-out member 13 will be described.

Figure 11:
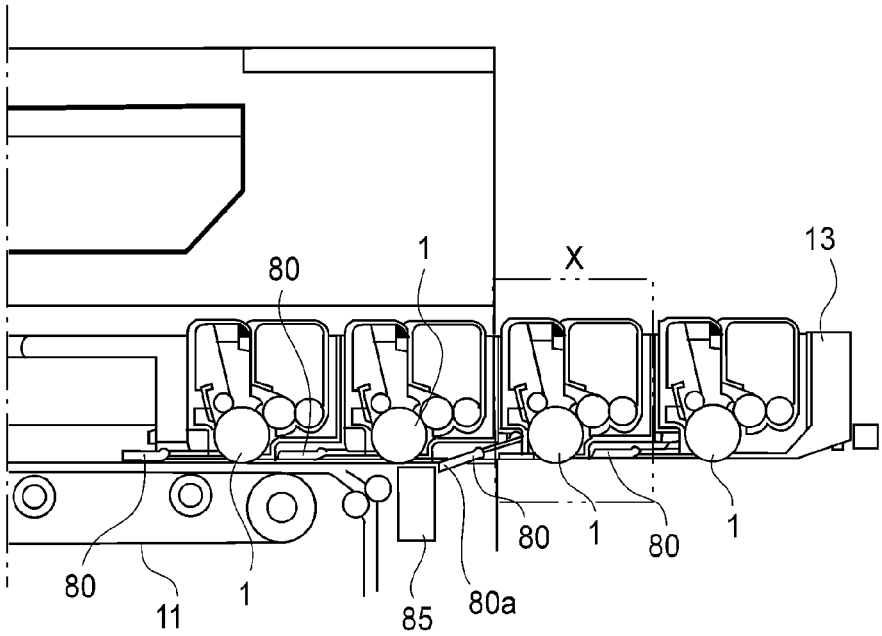
FIGS. 11(*a*) and 11(*b*) are a sectional view and a perspective view which show a step of inserting the pulling-out member into the apparatus main assembly in a state in which a cartridge different from a predetermined cartridge is mounted in one of four cartridge mounting portions.
Figure 11:
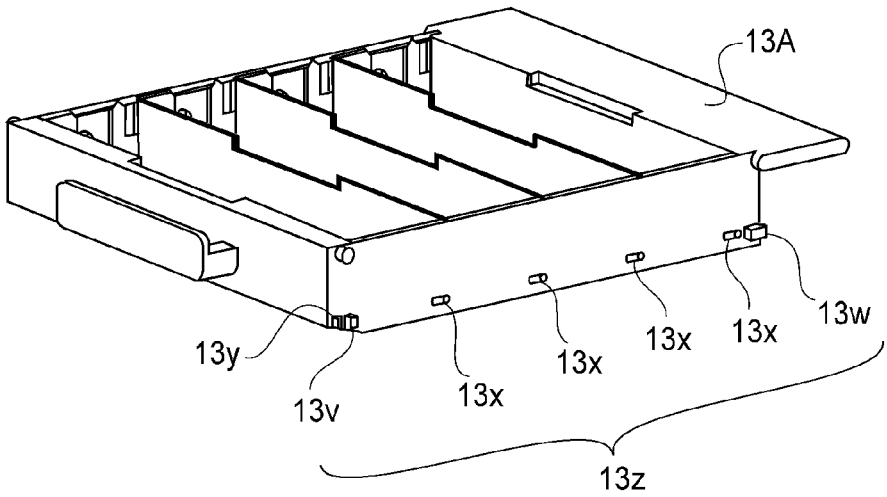

FIG. 11(*a*) is a sectional view showing a state in which the pulling-out member 13 is inserted into the apparatus main assembly 100A in a state in which the cartridge P different from the predetermined cartridge P is mounted in one of the mounting portions 13*f* of the pulling-out member 13. In FIG. 11(*a*), in a range enclosed by a chain double-dashed line X, the cartridge P different from the predetermined cartridge P is mounted in the mounting portion 13*f*. In the range, the stopper 80 is not rotated, so that the stopper portion 80*a* projects towards the lower side than the bottom surface of the pulling-out member 13 and the sectional view of the photosensitive drum 1. In such a state, when the pulling-out member 13 is inserted into the apparatus main assembly 100A, the stopper portion 80*a* contacts the preventing wall portion 85 of the apparatus main assembly 100A, so that the pulling-out member 13 cannot be further inserted in the apparatus main assembly 100A. Further, in the case, the preventing wall portion 85 and the stopper 80 are disposed so that the cartridge P different from the predetermined cartridge P is stopped on a side upstream of an opening 100*x* provided in the apparatus main assembly 100A with respect to the mounting direction.

Thus, in the case where the cartridge P different from the predetermined cartridge P is mounted in a certain mounting portion 13*f*, the pulling-out member 13 is placed in the state in which it cannot be inserted further into the apparatus main assembly 100A. In this case, the mounting portion 13*f* in which the different cartridge P is mounted is always located in the range, enclosed by the line X, immediately outside the apparatus main assembly 100A. In Embodiment 1, the stopper portion 80*a* projects toward the lower side also in the case where the cartridge P is not mounted in the mounting portion 13*f* and where the cartridge P is mounted incompletely and the rib 30*g* cannot rotate the stopper 80 sufficiently. Thus, the pulling-out member 13 is prevented from being inserted into the apparatus main assembly 100A.

In this way, the pulling-out member 13 cannot be inserted into the apparatus main assembly 100A at an intermediate position of the insertion, so that the user is notified that there is some problem with respect to the mounting of the cartridge P in the pulling-out member 13. For example, the user is notified of erroneous insertion of the cartridge, the cartridge forgot to be mounted, incomplete insertion of the cartridge, and the like. Further, it is also possible to notify the user that a problematic portion is the mounting portion 13*f* in the range enclosed by the line X.

As a result, the user can know that there is a problem of the mounting of the cartridge P in the pulling-out member 13 due to the inserting operation of the pulling-out member 13, so that an image trouble can be avoided in advance. Further, the user can know the problematic mounting portion 13*f*, so that the user can quickly solve the problem.

Next, a second releasing means for releasing the above-described function of the stopper 80 irrespective of the mounting of the predetermined cartridge P will be described with reference to FIG. 11(*b*), FIGS. 12(*a*) to 12(*d*) and FIGS. 13(*a*) and 13(*b*).

FIG. 11(*b*) is a perspective view showing a constitution of an attaching portion shape of a releasing operation member 90 formed on the pulling-out member 13. FIG. 12(*a*) is a perspective view showing a structure of the releasing operation member 90. As shown in FIG. 12(*a*), the releasing operation member 90 as the second releasing means contacts the stopper portion 80*a* to place the stopper portion 80*a* in the second attitude in the case where the cartridge P is not mounted in the pulling-out member 13, so that the movement prevention of the pulling-out member 13 is released. The releasing operation member 90 includes an operation portion 92 and a holding portion 91. The operation portion 92 includes an operation shaft portion 92*a*, a first portion to be supported 92*c* formed at an end of the operation shaft portion 92*a*, and operation contact portions 92*b* formed on a side surface of the operation shaft portion 92*a* at predetermined intervals. The operation shaft portion 92*a*, the first portion to be supported 92*c*, and the operation contact portions 92*b* are integrally formed. On the other hand, the holding portion 91 includes an operating portion 91*a*, a second portion to be supported 91*d* extending from the operating portion 91*a*, and a first position retaining projection 91*b* and a second position retaining projection 91*c* which are projected from (180 degree-) opposite side surfaces of the second portion to be supported 91*d*. The operating portion 91*a*, the second portion to be supported 91*d*, and the first and second position retaining projections 91*b* and 91*c* are integrally formed. The holding portion 91 is attached to the operation portion 92 so as to be rotatable about the operation shaft portion 92*a*.

Further, as shown in FIG. 11(*b*), the pulling-out member 13 is provided with an attaching portion 13*z* for the releasing operation member 90. That is, the pulling-out member 13 is provided with a plurality of openings 13*x* for permitting passing of the operation contact portions 92*b*, supporting portions 13*v* and 13*w* for supporting the two portions to be supported 91*d* and 92*c*, respectively, and a position retaining groove 13*y* engageable with the position retaining projections 91*b* and 91*c*. For this reason, the first portion to be supported 92*c* is supported by the supporting portion 13*v*, the operation contact portions 92*b* are inserted into the openings 13*x*, and the second portion to be supported 91*d* is supported by the supporting portion 13*w*.

FIGS. 12(*b*) and 12(*c*) are sectional views for illustrating the action of the releasing operation member 90 on the stopper 80. FIG. 12(*b*) shows a state in which the stopper portion 80*a* is lowered. FIG. 12(*c*) shows a state in which the stopper portion 80*a* is raised. FIG. 12(*d*) is a perspective view for illustrating the action of the releasing operation member 90 on the stopper 80. The action of the releasing operation member 90 will be described with reference to FIGS. 3B and 12(*a*). The releasing operation member 90 is attached slidably in the directions of the arrows K1 and K2 and the operation contact portions 92*b* pass through the openings 13*x* to be contactable to the rotation stopping contact portions 80*d* of the stoppers 80.

As shown in FIG. 12(*b*), when the releasing operation member is slid in the direction of the arrow k2, the operation contact portions 92*b* do not influence the stoppers 80.

On the other hand, as shown in FIGS. 12(*c*) and 12(*d*), when the releasing operation member 90 is slid in the direction of the arrow K1, the operation contact portions 92*b* push down the rotation stopping contact portions 80*d* of the stoppers 80. For that reason, the stoppers 80 are rotated in the direction of the arrow L2 shown in FIG. 9(*b*), so that the stopper portions 80*a* can be positioned above the bottom surface of the pulling-out member 13. That is, the action of the stoppers 80 can be released irrespective of whether or not the predetermined cartridges P are mounted at the respective inside positions I of the pulling-out member 13. Incidentally, in FIG. 12(*d*), each of the rotation stopping contact portions 80*d* is formed in a large width. For that reason, the rotation stopping cartridge portions 80*d* substantially have the function of a combination thereof with the portions to be contacted 80*c* in the case where these portions 80*d* and 80*c* are integrally provided.

FIGS. 13(*a*) and 13(*b*) are perspective views showing a mechanism for retaining the sliding position of the releasing operation member 90. As shown in FIG. 13(*a*), there are two position retaining projections consisting of the first position retaining projection 91*b* and the second position retaining project 91*c*. When the releasing operation member 90 is slid in the direction of the arrow K1 to rotate the operating portion 91*a* of the holding portion 91, the first position retaining projection 91*b* engages in the position retaining groove 13*y*, so that the releasing operation member 90 can be fixed at a position shown in FIG. 12(*b*) in which it does not influences the stoppers 80. On the other hand, when the releasing operation member 90 is slid in the direction of the arrow K2 to rotate the operating portion 91*a*, as shown in FIG. 13(*b*), the second position retaining projection 91*c* is caught by the end of the pulling-out member 13. As a result, the releasing operation member 90 can be fixed at the position shown in FIGS. 12(*c*) and 12(*d*) in which the action of the stoppers 80 is released.

By employing the releasing operation member 90, the function (action) of the stoppers 80 can be released by the user's intention irrespective of the mounting of the predetermined cartridges. For that reason, usability can be improved. For example, the pulling-out member 13 can be mounted in the apparatus main assembly 100A in the state in which the cartridges P are not mounted therein, so that it is also possible to mount the pulling-out member 13 in the apparatus main assembly 100A and to close the door 10 even in the case where the cartridge P is discarded due to toner shortage or the like case. Further, by employing the position retaining means, the releasing operation member 90 can be operated with high reliability.

In this embodiment, the stoppers 80 are provided only on the side of the first side wall 13*p* at the bottom surface of the pulling-out member 13. However, the stoppers 80 ma also be provided similarly on the side of the second side wall 13*q* at the bottom surface of the pulling-out member 13. As a result, the incomplete mounting of the cartridge P can be detected with high accuracy and the movement prevention of the pulling-out member 13 can be realized with high reliability.

As described above, according to this embodiment, the stoppers 80 are provided on the pulling-out member 13 and the function (action) of the stopper portions 80*a* is released only when the predetermined cartridges P are mounted in the associated mounting portions 13*f* of the pulling-out member 13. On the other hand, when the predetermined cartridges P are not mounted in the associated mounting portions 13*f* with reliability, the insertion of the pulling-out member 13 into the apparatus main assembly 100A is prevented by the function of the stopper portions 80*a*. Therefore, the user can know the erroneous mounting of the cartridge P, the cartridge P forgot to be mounted, or the incomplete mounting of the cartridge P, into the pulling-out member 13 during the insertion of the cartridge P into the pulling-out member 13. Further, the user can know the problematic mounting portion. For that reason, a trouble such as image defect or image deterioration can be prevented. Further, the user can solve the trouble quickly. Further, usability is improved by providing the releasing operation member 90.

Embodiment 2

Figure 14:
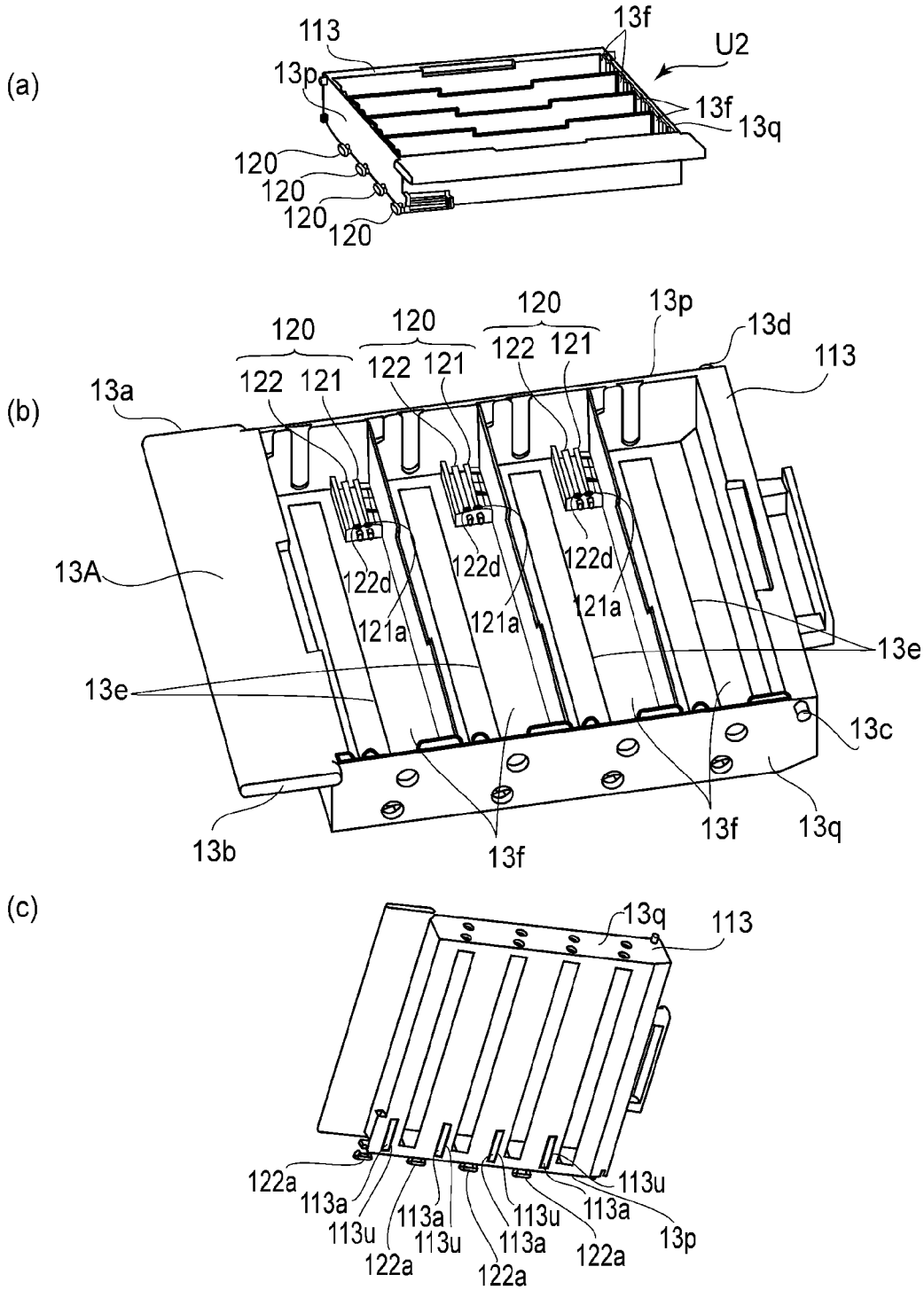
FIGS. 14(*a*) to 14(*c*) are perspective views showing a structure of a pulling-out member provided in an image forming apparatus in Embodiment 2.

FIG. 14(*a*) is a perspective view showing a structure of a pulling-out member 113 provided in an image forming apparatus in this embodiment. Constitutions and effects of the pulling-out member 113 in this embodiment identical to those of the pulling-out member 13 in Embodiment 1 will be omitted from description appropriately by using the same reference numerals or symbols. Also in this embodiment, the pulling-out member 113 can be applied to the image forming apparatus 100 similarly as the case of the pulling-out member 13 in Embodiment 1 and therefore the image forming apparatus 100 will be omitted from description. A difference between the pulling-out member 113 in this embodiment and the pulling-out member 13 in Embodiment 1 is as follows. In Embodiment 1, the pulling-out member 13 is provided with the four stoppers 80. On the other hand, in Embodiment 2, a single stopper 180 (FIGS. 17(*a*) and 17(*b*)) which is a first preventing means (member) is provided in the apparatus main assembly 100. In Embodiment 2, the pulling-out member 113 is provided with stopper guides 120 which are a releasing means for controlling a rotational position of the stopper 180 by rotating the stopper 180 correspondingly to each of the mounting portions 13*f*. However, as shown in FIG. 14(*a*), a pulling-out unit U2 includes the pulling-out member 113 and four stopper guides 120. In the pulling-out member 113, four mounting portions 13*f* are formed, and the stopper guides 120 are attached correspondingly to the respective mounting portions 13*f*.

FIG. 14(*b*) is a perspective view showing a structure of the stopper guides 120. As shown in FIG. 14(*b*), the portions to be guided 13*a* to 13*d* and the openings 13*e* and the like for permitting mounting of the pulling-out member 113 into the apparatus main assembly 100A have the same constitutions as those in Embodiment 1. Further, as shown in FIG. 14(*b*), at the bottom surface of the pulling-out member 113 on the first side wall 13*p* side, the stopper guides 120 are provided correspondingly to the mounting portions 13*f*. Each stopper guide 120 includes a first stopper guide 121 and a second stopper guide 122. These (first and second) stopper guides 121 and 122 are rotatably attached to the pulling-out member 113 and are configured to be interrelated with each other by engagement of gear portions 121*a* and 122*d* provided on the first and second stopper guides 121 and 122, respectively.

Figure 19:
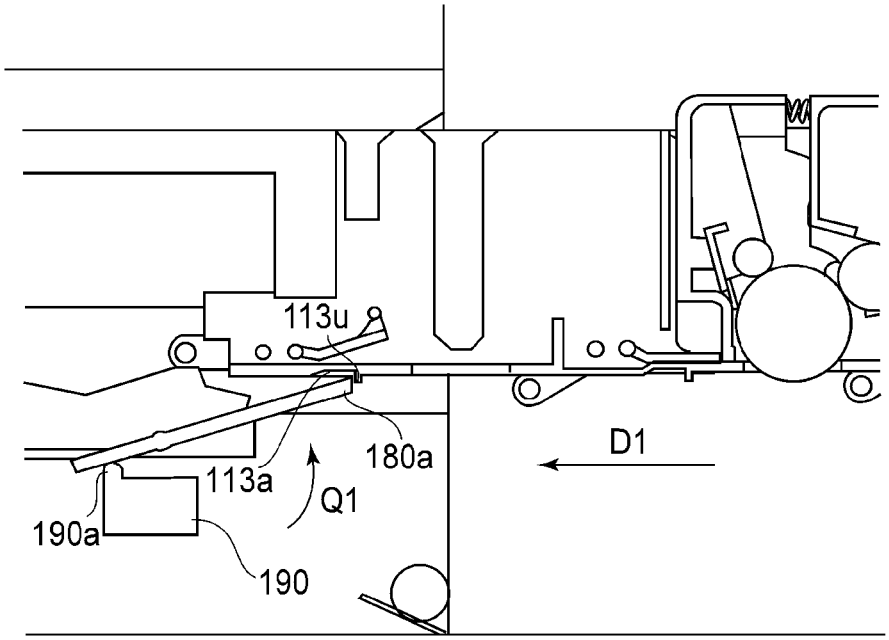
FIGS. 19(*a*) and 19(*b*) are sectional views showing a state in which a stopper portion enters a recessed portion of the pulling-out member.
Figure 19:
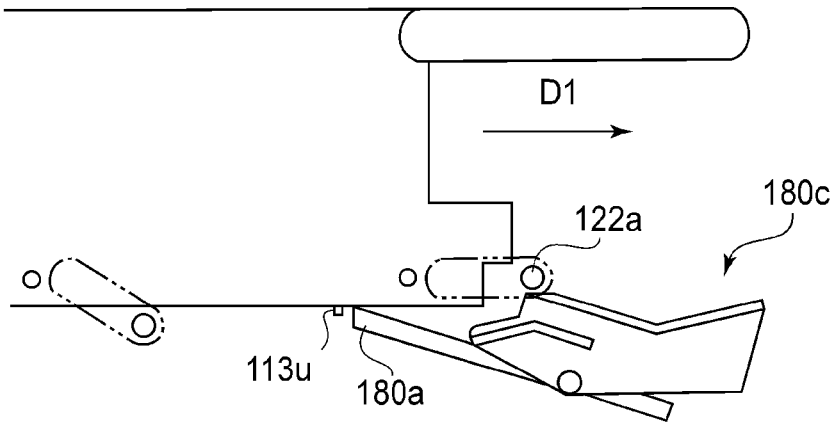

FIG. 14(*c*) is a perspective view showing a structure of a pulling-out wall portion 113*u* and a pulling-out recessed portion 113*a*. As shown in FIG. 14(*c*), at the bottom (lower) surface of the release operation member 113, the pulling-out wall portion 113*u* as a portion to be prevented is provided. Further, at the bottom surface of the pulling-out member 113, the pulling-out recessed portion 113*a* is provided adjacent to the pulling-out wall portion 113*u*. The structure of the pulling-out wall portion 113*u* and the pulling-out recessed portion 113*a* is also shown in FIG. 19(*a*). The pulling-out wall portion 113*u* is projected from the bottom surface of the pulling-out member 113. The pulling-out wall portion 113*u* contacts a stopper portion 180*a* taking the first attitude to prevent the movement of the pulling-out member 113. The pulling-out recessed portion 113*a* is formed to be recessed on the side toward the pushing-in direction D1 while being adjacent to the pulling-out wall portion 113*u*. The pulling-out recessed portion 113*a* is provided so that it can prevent the movement of the stopper portion 180*a* even when the pulling-out wall portion 113*u* is not projected from the bottom surface of the pulling-out member 113.

Figure 15:
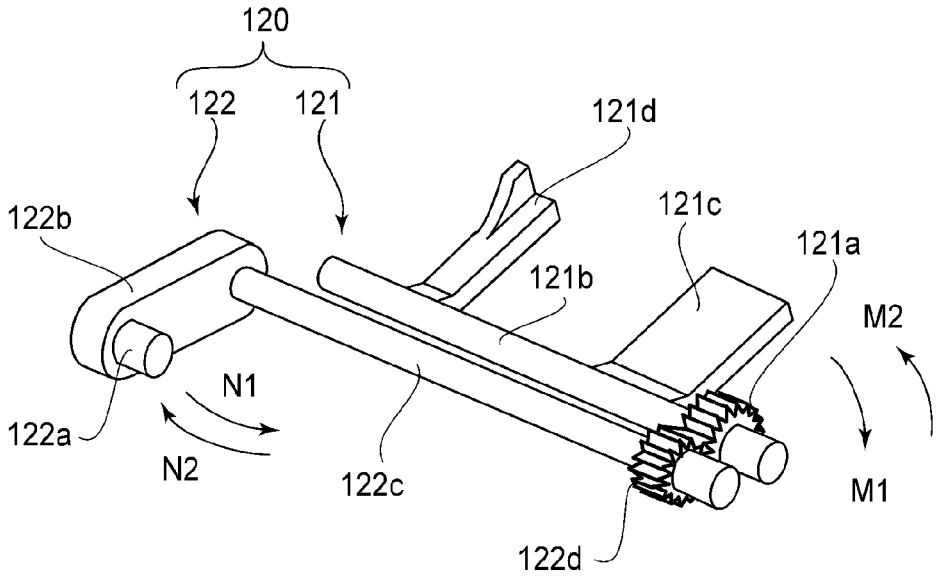
FIGS. 15(*a*) and 15(*b*) are perspective views showing a structure of a stopper guide.
Figure 15:
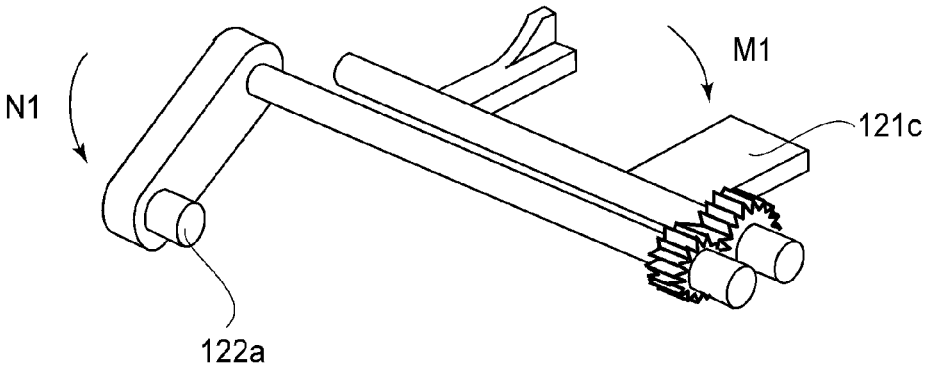

FIGS. 15(*a*) and 15(*b*) are perspective views showing a structure of the stopper guide 120 as a releasing means. FIG. 15(*a*) shows an operation step of the stopper guide 120 when the movement of the pulling-out member 13 is prevented. FIG. 15(*b*) shows an operation step of the stopper guide 120 when the movement of the pulling-out member 13 is accelerated. As shown in FIG. 15(*a*), the stopper guide 120 includes a first stopper guide 121 and a second stopper guide 122. Each of the first stopper guide 121 and the second stopper guide 122 is provided on the pulling-out member 113 so as to be rotatable about a shaft portion 121*a* or 122*d*. These stopper guides 121 and 122 are interrelated with each other by engagement between gear portions 121*a* and 122*d* thereof. As shown in FIG. 15(*b*), when the first stopper guide 121 is rotated in a direction indicated by an arrow M1, the second stopper guide 122 is configured to be rotated in a direction indicated by an arrow N1.

The first stopper guide 121 includes, similarly as in the case of the stopper 80 in Embodiment 1, a portion to be contacted 121*c* and a rotation stopping contact portion 121*d* and is urged, in a direction indicated by an arrow M2, by a helical coil spring. Further, the first stopper guide 121 is retained at a position in which the rotation stopping contact portion 121*d* contacts a stopper stopping portion of the pulling-out member 113. The portions to be contacted 121*c* in this embodiment are different in longitudinal position for each of the mounting portions 13*f* similarly as in Embodiment 1.

The second stopper guide includes a guide arm 122*b* and a guide projection 122*a*. When the second stopper guide 122 is rotated in the direction of the arrow N1, the guide projection 122*a* is moved downward. This guide projection is moved to a lower position than the bottom surface of the pulling-out member 113 relative to the pulling-out member 113.

Figure 16:
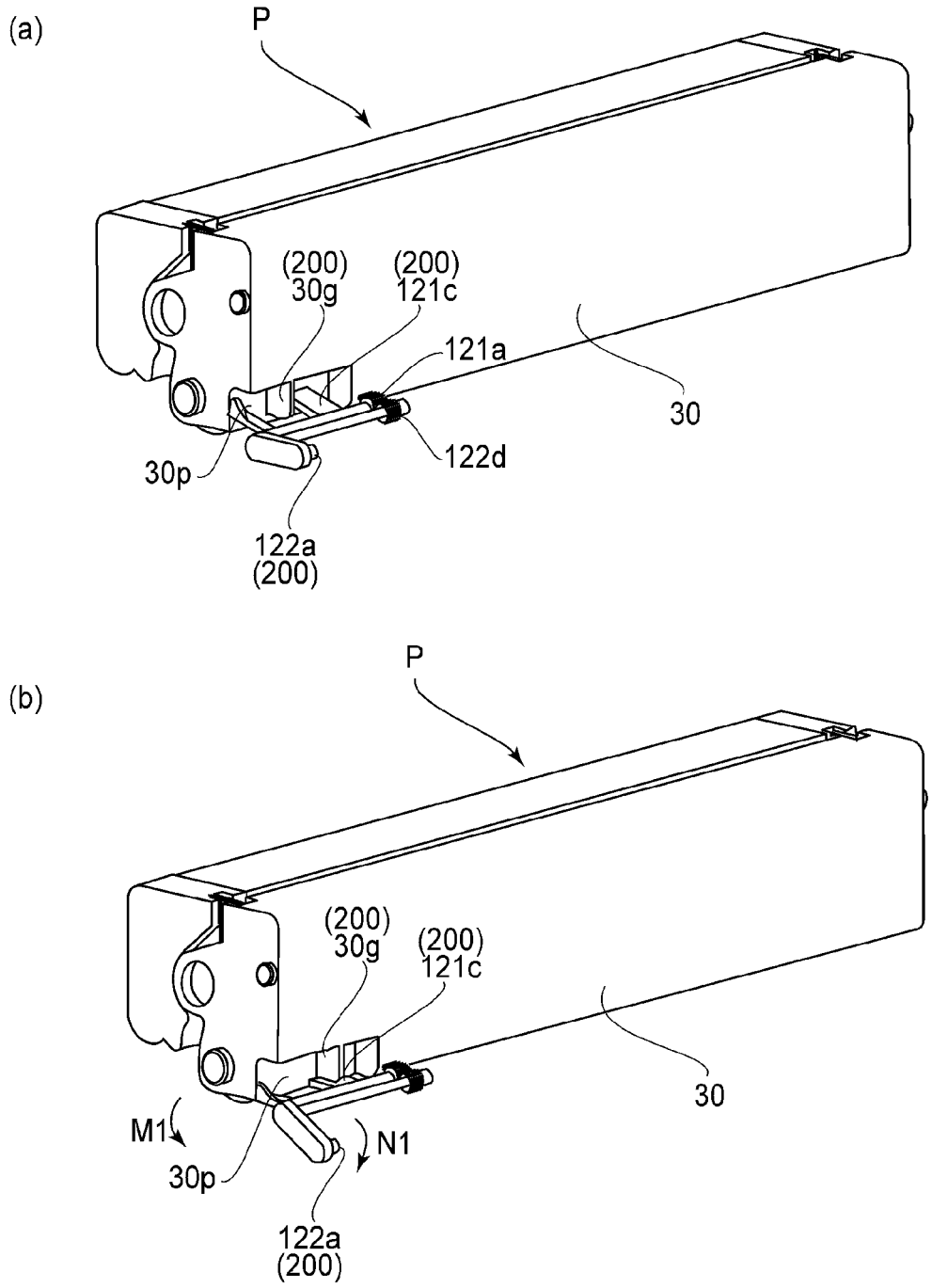
FIGS. 16(*a*) and 16(*b*) are perspective views showing a positional relation between a contact portion and a cartridge.

FIGS. 16(*a*) and 16(*b*) are perspective views showing a positional relation among a rib 30*g*, the portion to be contacted 121*c*, and the cartridge P. FIG. 16(*a*) is the perspective view showing the position relation among the rib 30*g*, the portion to be contacted 121*c* and the guide projection 122*a* when the movement of the pulling-out member 113 is prevented. FIG. 16(*b*) is the perspective view showing a positional relation among the rib 30*g*, the portion to be contacted 121*c* and the guide projection 122*a* when the movement of the pulling-out member 113 is accelerated. As shown in FIGS. 16(*a*) and 16(*b*), similarly as in Embodiment 1, the cartridge P is provided with the rib 30*g* (contact portion) as the first releasing means. Further, the pulling-out wall portion 113*u* and the rib 30*g* are provided correspondingly to each of the plurality of mounting portions 13*f*. Each cartridge P is provided with the recessed portion 30*p* and the rib 30*g*. The longitudinal position of the rib 30*g* is different every cartridge P.

When the predetermined P is mounted in the mounting portion 13*f*, as shown in FIG. 16(*b*), the rib 30*g* contacts the portion to be contacted 121*c*, so that the gear portions 121*a* and the 122*d* are rotated in opposite directions. As a result, the first stopper guide 121 is rotated in the direction of the arrow M1 and the second stopper guide 122 is rotated in the direction of the arrow M2 to move the guide projection 122*a* downward.

When the cartridge different from the predetermined cartridge P is mounted in the mounting portion 13*f*, as shown in FIG. 16(*a*), the portion to be contacted 131*a* is retained in the state in which it is urged upward, so that the second stopper guide 122 is not moved and the guide projection 122*a* is not moved downward.

FIG. 17(*a*) is a perspective view showing a structure of the stopper 180 provided in the apparatus main assembly 100A. FIG. 17(*b*) is an enlarged perspective view showing the structure of the stopper 180. As shown in FIG. 17(*a*), in the apparatus main assembly 100A, the stopper portion 180*a* is provided. The stopper portion 180*a* takes the first attitude in which the end of the stopper portion 180*a* is moved toward the movement path of the pulling-out member 113 when the cartridge portion associated with the mounting portion 13*f* is not mounted. Further, the stopper portion 180*a* takes the second attitude in which the end of the stopper portion 180*a* is retracted from the movement path of the pulling-out member 113 when the cartridge develop associated with the mounting portion 13*f* is mounted in the mounting portion 13*f*. Hereinafter, the stopper 180 will be described more specifically. First, the apparatus main assembly 100A is provided with a stopper attaching portion 190. The stopper attaching portion 190 rotatably supports a portion to be supported 180*b* of the stopper 180. As shown in FIG. 17(*b*), the stopper 180 includes the portion to be supported 180*b*, the stopper portion 180*a* and a portion to be guided 180*c*. The stopper portion 180*a* is a flat plane including the portion to be supported 180*b* and is fixed on the portion to be supported 180*b*. Further, the portion to be guided 180*c* includes a first surface 180*c*1 where its inclined surface portion is gradually raised toward the pushing-in direction D1, a second surface 180*c*2 where its inclined surface portion is higher than that of the first surface 180*c*1 and is gradually lowered toward the pushing-in direction D1, and a third surface 180*c*3 which extends from the second surface 180*c*2 and its inclined surface portion is gradually raised toward the pushing-in direction D1.

Figure 18:
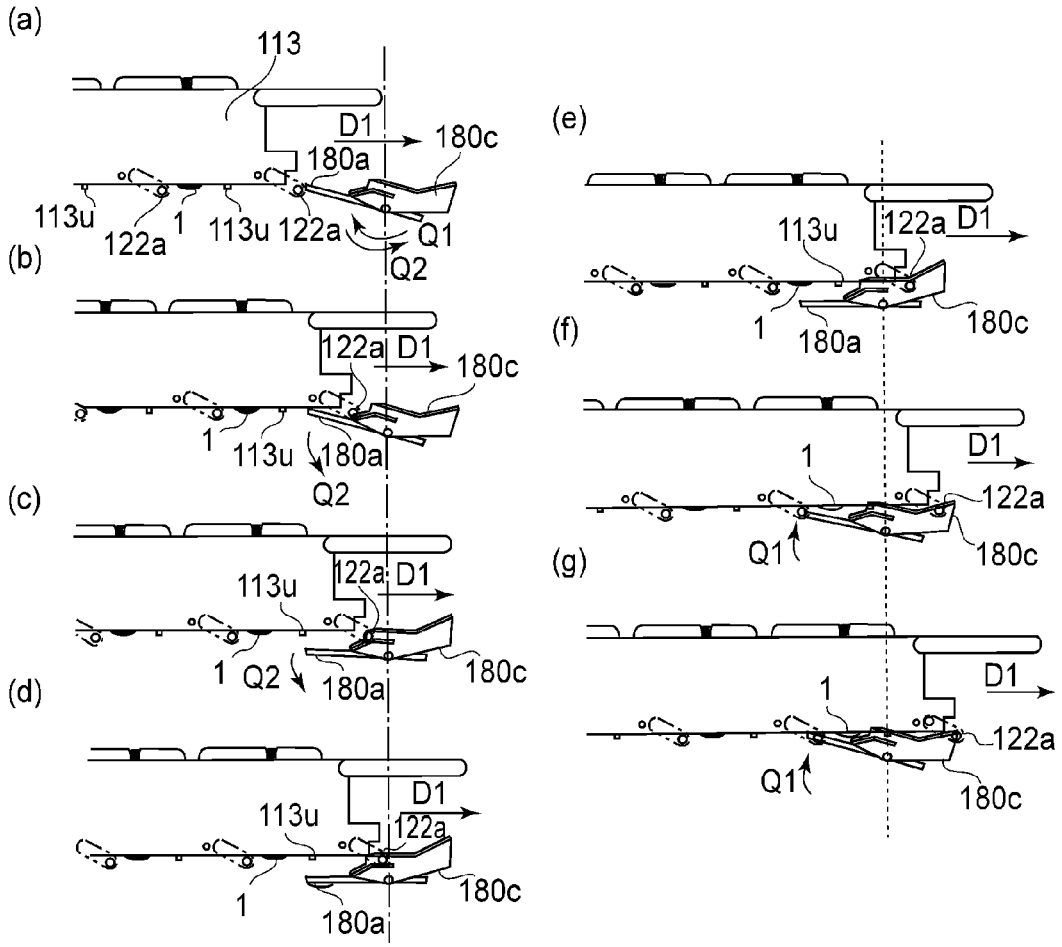
FIGS. 18(*a*) to 18(*g*) are sectional views showing a step of inserting the pulling-out member into the apparatus main assembly.

FIGS. 18(*a*) to 18(*g*) are schematic sectional views showing a step of inserting the pulling-out member 113 into the apparatus main assembly 100A. FIGS. 18(*a*) to 18(*g*) show the step in which the pulling-out member 113 is inserted into the apparatus main assembly 100A in the state in which the predetermined cartridges P are mounted in the mounting portions 13*f* and are the surfaces showing positional relation between the guide projection 122*a* and the stopper 180. As shown in FIG. 18(*a*), the stopper portion 180*a* is urged in a direction of an arrow Q1 by a helical coil spring. At this time, the stopper portion 180*a* contacts a stopping portion 190*a* of the stopper attaching portion 190 and the position thereof is retained (FIG. 17(*a*)).

An operation of the stopper 180 will be described with reference to FIGS. 18(*a*) to 18(*g*). First, the case where an operation for mounting the pulling-out member 113 into the apparatus main assembly 100A in the state in which the predetermined cartridges P are mounted in the mounting portions 13*f* is performed will be described. When the predetermined cartridges P are mounted in the mounting portions 13*f* of the pulling-out member 113, as shown in FIG. 18(*a*), the guide projections 122*a* moved downward. The position of the stopper guide 120 at this time is referred to as a releasing position.

From this state, when the pulling-out member 113 is inserted into the apparatus main assembly 100A in the pushing-in direction D1, as shown in FIG. 18(*b*), the guide projection 122*a* contacts the first surface 180*c*1 (FIG. 17(*b*)) of the portion to be guided 180*c* of the stopper 180.

When the pulling-out member 113 is further inserted into the apparatus main assembly 100A in the pushing-in direction D1, as shown in FIG. 18(*c*), the stopper 180 is rotated in the direction of the arrow Q2 against the urging force of the helical coil spring. By this rotation of the stopper portion 180*a*, when the end of the stopper portion 180*a* is lowered (second attitude), the stopper portion 180*a* is prevented from contacting the pulling-out wall portion 113*u*. When the pulling-out member 113 is further inserted into the apparatus main assembly 100A, as shown in FIGS. 8(*d*) and 18(*e*), the guide projection 122*a* moves forward while contacting the second surface 180*c*2, so that the rotational position of the stopper 180 is substantially retained. As shown in FIG. 18(*e*), in the state in which the guide projection 122*a* contacts the second surface 180*c*2, the pulling-out member 113 is inserted into the apparatus main assembly 100A.

Then, as shown in FIG. 18(*f*), the guide projection moves from the second surface 180*c*2 (FIG. 17(*b*)) to the third surface 180*c*2 (FIG. 17(*b*)), so that the stopper portion 180*a* is rotated in the direction of the arrow Q1 to be raised. However, at this position, the stopper portion 180*a* does not contact the pulling-out wall portion 113*u*. The stopper portion 180*a* and the guide projection 122*a* are deviated from each other with respect to the longitudinal direction. When the pulling-out member 113 is further inserted into the apparatus main assembly 100A, the end of the stopper portion 180*a* is returned to the original position. However, in this case, the stopper portion 180*a* has already been raised to a position higher than the pulling-out wall portion 113*u* and the photosensitive drum 1, so that the stopper portion 180*a* does not contact the pulling-out wall portion 113*u*.

As described above, the releasing means is constituted by the rib 30*g*, the portion to be contacted 121*c*, the guide projection 122*a* and the portion to be guided 180*c*. In the state in which the guide projection 122*a* of the second stopper guide 122 of the pulling-out member 113 is moved downward, the stopper portion 180*a* is rotated so as not to prevent the insertion of the pulling-out member 113. When the process cartridge cartridges P are mounted in the associated four mounting portions 13*f*, respectively, all the four guide projections 122*a* have been moved downward. For that reason, even when the above-described rotation (movement) of the stopper 180 occurs four times, the stopper portion 180*a* does not prevent the insertion of the pulling-out member 113, so that the pulling-out member 113 is smoothly mounted into the apparatus main assembly 100A.

FIGS. 19(*a*) and 19(*b*) are side views showing an operation step of the stopper portion 180*a* when the predetermined cartridge is not mounted in the mounting portion 13*f* of the pulling-out member 113. FIG. 19(*a*) is a sectional view showing a state in which the stopper portion 180*a* enters the pulling-out recessed portion 113*a*. FIG. 18(*b*) is a sectional view showing a state in which the stopper portion 180*a* approaches the pulling-out wall portion 113*u*. Here, the operation step in the case where the predetermined cartridge P is not mounted in the mounting portion 13*f* and the pulling-out member 113 is inserted into the apparatus main assembly 100A will be described.

As shown in FIG. 19(*a*), in the case where the cartridge P itself is not mounted in the mounting portion 13*f* the end of the guide projection 122*a* is located at an upper position as shown in FIG. 19(*b*). The position of the stopper guide 120 at this time is referred to as a non-releasing position. At this position, as shown in FIG. 19(*b*), the guide projection 122*a* does not contact the portion to be guided 180*c*, so that the stopper 180 is not rotated (first attitude). For this reason, as shown in FIG. 19(*a*), the stopper portion 180*a* of the stopper 180 contacts the pulling-out wall portion 113*u* at the bottom surface of the pulling-out member 113, so that the pulling-out member 113 cannot be inserted further. This phenomenon is similarly observed in either of the case where the cartridge P different from the predetermined cartridge P is mounted in the mounting portion 13*f* and the case where the predetermined cartridge P is not mounted properly.

As described above, a releasing mechanism 200 are provided on or in the cartridge P, the pulling-out member 113 and the apparatus main assembly 100A. That is, the releasing mechanism 200 includes the rib 30*g* formed at a predetermined portion of the cartridge P and the portion to be contacted 121*c* provided on the pulling-out member 113 and contactable to the rib 30*g* by the rotation, wherein the positions of the rib 30*g* and the portion to be contacted 121*c* are interrelated with each other with respect to the longitudinal direction of the cartridge P. Further, the releasing mechanism 200 includes the guide projection 122*a* which is a projection provided in the apparatus main assembly 100A and rotated in interrelated with the portion to be contacted 121*c*. Further, the guide mechanism 200 includes the portion to be guided 180*c* which is a portion to be contacted for placing the stopper portion 180*a* in the second attitude by passing of the guide projection 122*a* therethrough while the guide projection 122*a* contacts the portion to be guided 180*c*. The stopper portion 180*a* takes the first attitude by being urged by the urging member and takes the second attitude by the contact of the portion to be contacted 121*c* with the portion to be guided 180*c*. The pulling-out wall portion 113*u* is projected from the rear surface of the pulling-out member 113 toward the movement path of the pulling-out member 113 and is contacted by the stopper portion 180*a* which takes the first attitude. In the case where the cartridge P is not mounted in the pulling-out member 113, the movement prevention of the pulling-out member 113 is released by the preventing wall portion 85 and the stopper portion 180*a*.

As described above, according to this embodiment, the stopper 180 is provided in the apparatus main assembly 100A, the stopper guide 120 is provided on the pulling-out member 113 and the function (action) of the stopper 80 is released only when the predetermined cartridges P are mounted in the associated mounting portions 13*f* of the pulling-out member 13. On the other hand, when the predetermined cartridges P are not mounted in the associated mounting portions 13*f* with reliability, the insertion of the pulling-out member 113 into the apparatus main assembly 100A is prevented by the function of the stopper portions 180*a*. Therefore, the user can know the erroneous mounting of the cartridge P, the cartridge P forgot to be mounted, or the incomplete mounting of the cartridge P, into the pulling-out member 113 during the insertion of the cartridge P into the pulling-out member 113. Further, the user can know the problematic mounting portion. For that reason, a trouble such as image defect or image deterioration can be prevented. Further, the user can solve the trouble quickly.

Incidentally, in the constitution of this embodiment, the releasing operation member 90 as the second releasing means is not employed, a releasing operation means similar to the releasing operation member 90 used in Embodiment 1 is applicable.

Embodiment 3

Figure 20:
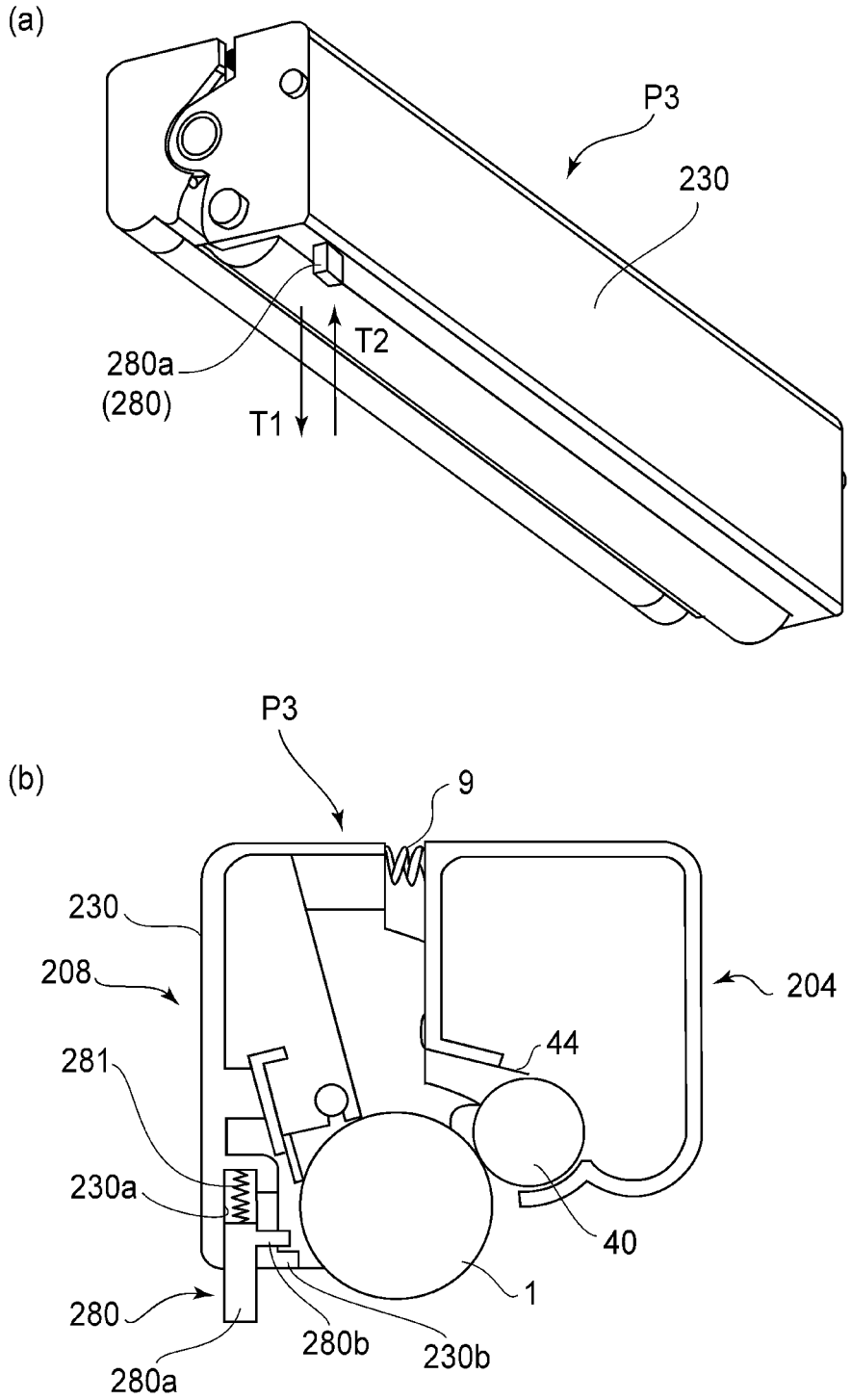
FIGS. 20(*a*) and 20(*b*) are a perspective view and a sectional view which show a cartridge to be mounted into and demounted from an image forming apparatus in Embodiment 3.

FIG. 20(*a*) is a perspective view cartridge P3 to be mounted into and demounted from an image forming apparatus in this embodiment as seen from obliquely below the cartridge P3. Also in this embodiment, the pulling-out member 113 can be applied to the image forming apparatus 100 similarly as the case of the pulling-out member 13 in Embodiment 1 and therefore the image forming apparatus 100 will be omitted from description. A difference between the constitution in this embodiment and the constitution in Embodiment 1 or Embodiment 2 is as follows. In Embodiment 1, the pulling-out member 13 is provided with the four stoppers 80. In Embodiment 2, the single stopper 180 is provided in the apparatus main assembly 100A and the stopper guide 120 is provided on the pulling-out member 113. On the other hand, in Embodiment 3, a stopper 280 is provided on each of the cartridges P3. Other constitutions of the cartridge P3 are roughly similar to those of the cartridge P in Embodiments 1 and 2. That is, as shown in FIG. 20(*a*), a residual toner container 230 of the cartridge P is provided with a projection stopper 280 projecting downward. The stopper 280 is attached to the container 230 slidably in directions indicated by arrows T1 and T2.

FIG. 20(*b*) is a sectional view showing a structure of the cartridge P3. As shown in FIG. 20(*b*), the cartridge P3 includes a developing unit 204 and a photosensitive member unit 208. The developing unit 204 includes the developing roller 40. The photosensitive member unit 208 includes the photosensitive drum 1. The photosensitive member unit 208 further includes the residual toner container 230. The residual toner container is provided with a recessed portion 230*a*. Into the recessed portion 230*a*, a compression spring 281 is inserted, and a base end portion of the spring 281 is fixed at a most rear portion of the recessed portion 230*a*. Further, into the recessed portion 230*a*, the stopper 280 is inserted. The stopper 280 includes a stopper portion 280*a* extending in an expansion and contraction direction of the spring 281 and includes a stopping portion projecting in a direction perpendicular to the expansion and contraction direction. At an end of the spring 281, the stopper 280 is disposed. At an entrance of an opening of the recessed portion 230*a* of the residual toner container 230, a preventing wall portion 230*b* is formed. By employing such a constitution, the stopper 280 is urged from the residual toner container 230 toward the projection direction by expansion of the compression spring 281. At the same time, the stopping portion 280*b* contacts the preventing wall portion 230*b*, so that the projection of the stopper portion 280*a* is restricted.

Thus, the cartridge P3 is provided with the stopper portion 280*a* as a perspective viewing member (means). The stopper portion 280*a* takes a projection attitude (first attitude) by being urged by an urging member. The stopper portion 280*a* takes a retraction attitude (second attitude) by being pressed to be retracted into the cartridge P3. That is, the stopper portion 280*a* takes the first attitude in which its end portion is moved toward the movement path of a pulling-out member 213 in the case where the cartridge P2 associated with a mounting portion 213*f* is not mounted. Further, the stopper portion 280*a* takes the second attitude in which its end portion is retracted from the movement path of the pulling-out member 213 in the case where the cartridge P3 associated with the mounting portion 213*f* is mounted.

Figure 21:
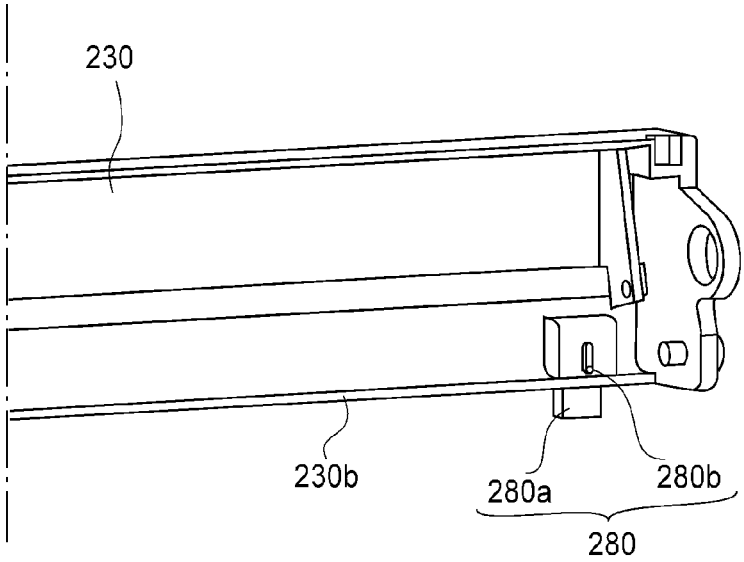
FIG. 21 is a perspective view of a residual toner container as seen from a developing unit side.

FIG. 21 is a perspective view of the residual toner container as seen from the developing unit 204 side. FIG. 21 shows a disposition relation between the stopper 280 and the preventing wall portion 230*b*. As shown in FIG. 21, the stopping portion 280*b* is caught by the preventing wall portion 230*b*, so that the stopper portion 280*a* is retained in a state in which the stopper portion 280*a* projects from the residual toner container 230. On the other hand, in the case where a force more than an elastic force of the compression spring 281 is applied to the stopper portion 280*a* from below, the stopper portion 280*a* is configured to be retracted into the residual toner container 230. The stoppers 280 for the cartridges P3 are disposed at different positions every type of the cartridges P3 with respect to the longitudinal direction.

Figure 22:
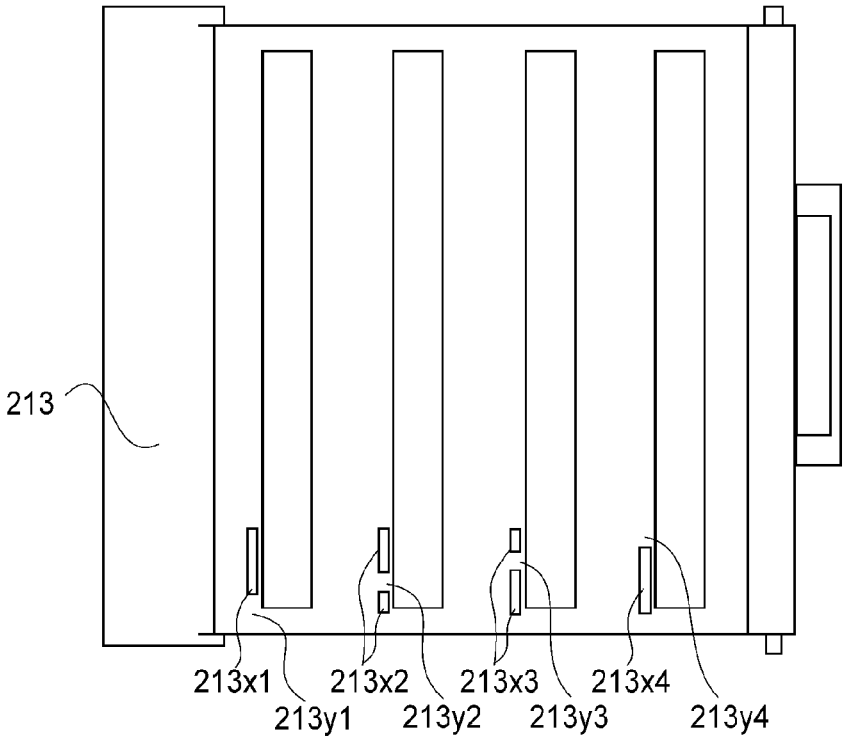
FIG. 22 is a rear view showing a structure of a pulling-out member.

FIG. 22 is a rear (bottom) view showing a structure of the pulling-out member 213. As shown in FIG. 22, no a rear (bottom) surface of the pulling-out member 213, a plurality of, i.e., four openings 213x1, 213x2, 213x3 and 213x4 are formed. On the rear surface of the pulling-out member 213, closing portions 213y (213y1, 213y2, 213y3 and 213y4) (first releasing means) which are closed at different positions with respect to the longitudinal direction and which are adjacent to the openings 213x1 to 213x4. Each closing portion 213y is a plate portion which is disposed in association with the position of the stopper portions 280a with respect to the longitudinal direction of the cartridge P3 and which is defined by the bottom surface of the pulling-out member 213. The stopper portion 280a as a perspective viewing portion and the closing portion 213y as the first releasing means are provided correspondingly to each of the plurality of mounting portions 213f. The closing portions 213y1 to 213y4 function as portions for stopping the stopper portions 280a.

Figure 23:
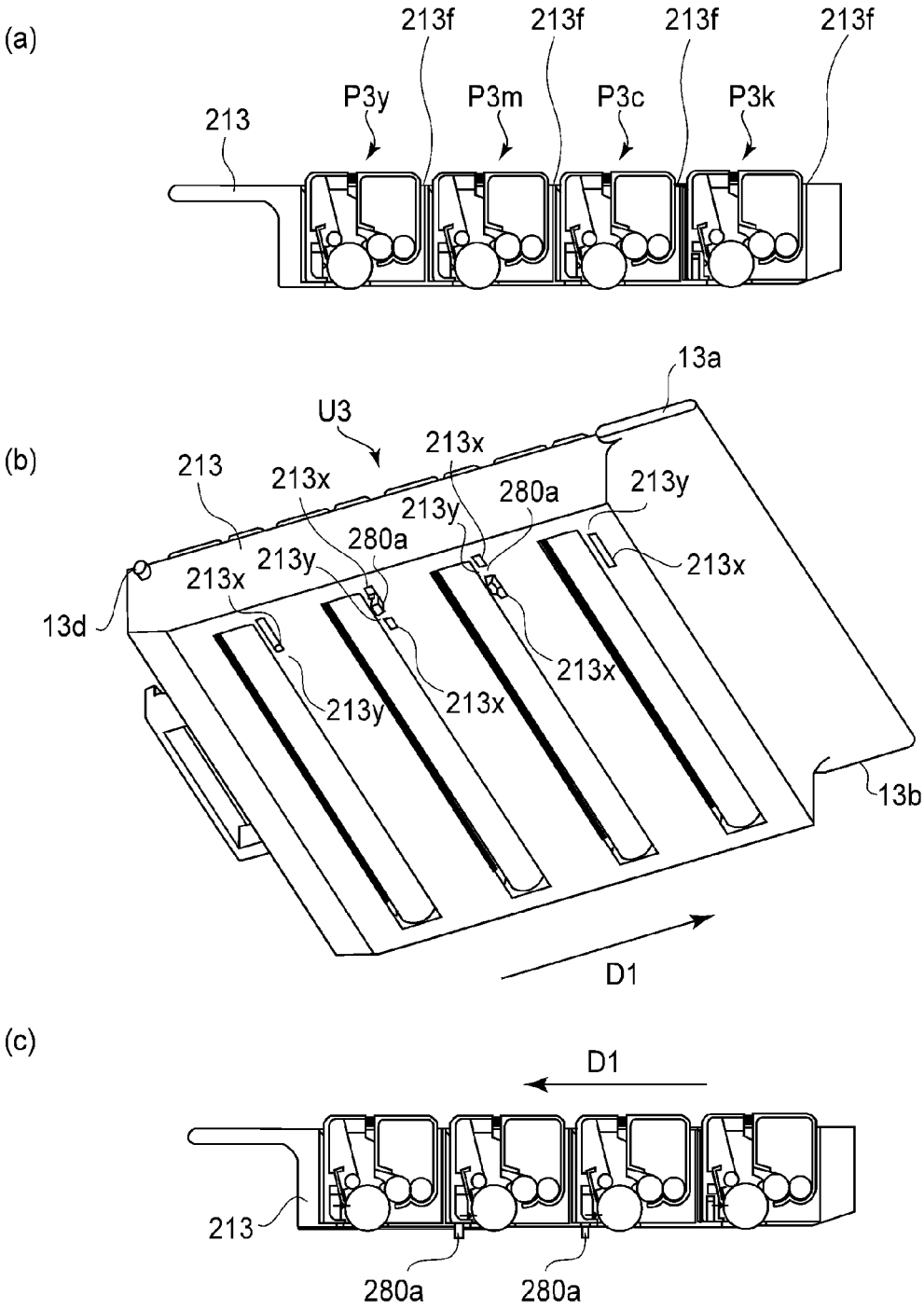
FIGS. 23(*a*) to 23(*c*) are sectional and perspective views showing a state in which predetermined cartridges are mounted in cartridge mounting portions.

FIG. 23(a) is a sectional view showing a constitution in which predetermined cartridges P3y, P3m, P3c and P3k are mounted in the associated mounting portions 213f, respectively. As shown in FIG. 23(a), in the case where the predetermined cartridges P3y to P3k are mounted in the mounting portions 213f as a cartridge mounting portion, the stopper portions 280a are in a state in which they are not projected downward from the bottom surface of the pulling-out member 213.

That is, when the cartridges P3y to P3k are mounted in the mounting portions 213f, the stopper portions 280a provided on the cartridges P3y to P3k are pushed up by the closing portions 213y. Then, as shown in FIG. 23(a), each stopper portion 280a is retracted into the residual toner container 230 of the cartridge P3, so that the pulling-out member 213 is mounted into the apparatus main assembly 100A with no problem to permit the image formation. The opening 213x and the adjacent closing portion 213y constitute the first releasing means.

FIG. 23(b) is a perspective view showing a disposition relation among the stopper portions 280a and the openings 213x1 to 213x4. As shown in FIG. 23(b), with respect to the pushing-in direction D1 of the pulling-out member 213, the state in the case where the cartridges different from the predetermined cartridges P3 are mounted, the stopper portions 280 is as follows. That is, the stopper portions 280a are placed in a state in which they cannot contact the closing portions 213y2 and 213y3 and are projected from the openings 213x2 and 213x3. Incidentally, constitutions or the like of the portions to be guided 13a to 13d when the pulling-out member 213 is mounted into the apparatus main assembly 100A, the guide portions 13h when the cartridges P3 are mounted into the pulling-out member 213, and the openings 13e for permitting passing of the cartridges P3 are similar to those in Embodiment 1.

FIG. 23(c) is a sectional view showing a positional relation between the stopper portions 280a and the bottom surface of the pulling-out member 213. As shown in FIG. 23(c), the state in the case where the predetermined cartridges P3y to P3k are not mounted in the associated mounting portions 213f of the pulling-out member 213 but the cartridges different from the predetermined cartridges P3y to P3k are mounted in the mounting portions 213f, i.e., in the case of erroneous mounting is as follows. That is, the stopper portions 280a are projected from the bottom surface of the pulling-out member 213. In FIG. 23(c), of the four mounting portions 213f, the erroneous mounting is performed in the second and third mounting portions 213f with respect to the pushing-in direction D1 of the pulling-out member 213.

Figure 24:
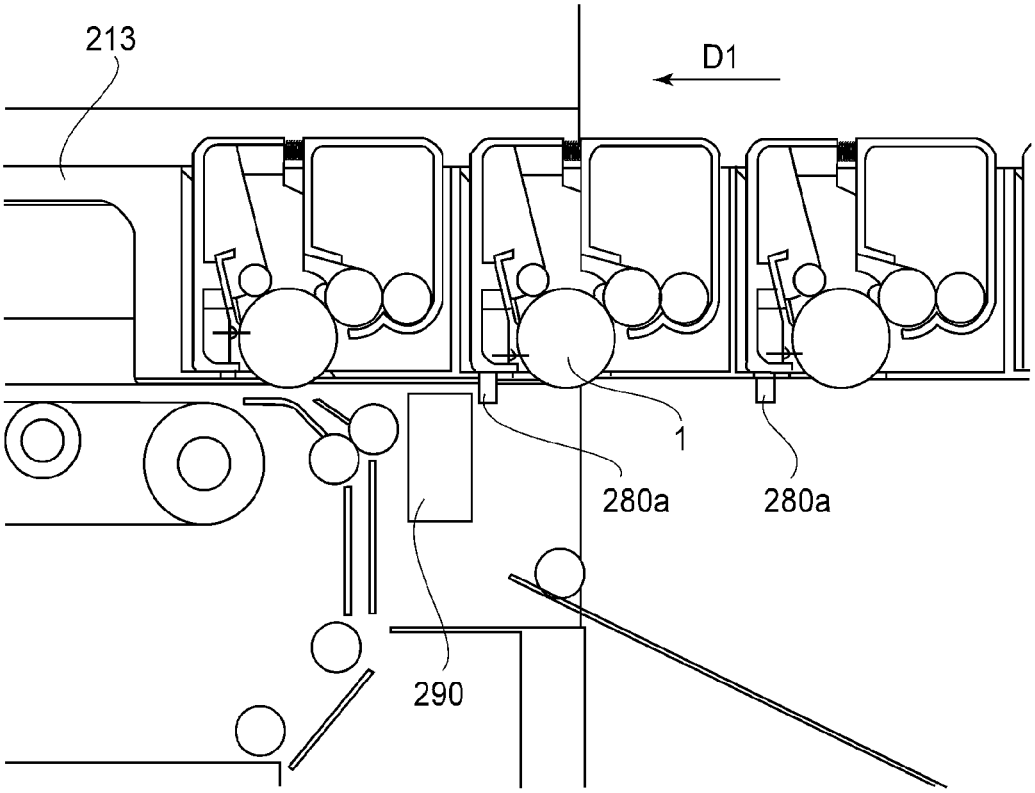
FIG. 24 is a sectional view showing a state in which the pulling-out member is being inserted into an apparatus main assembly in the case where predetermined cartridges are not mounted in the cartridge mounting portions of the pulling-out member.

FIG. 24 is a sectional view showing a state in which the pulling-out member 213 is being inserted into the apparatus main assembly 100A in the pushing-in direction D1 in the case where the predetermined cartridges P3y to P3k are not mounted into the associated mounting portions 213f of the pulling-out member 213. In the apparatus main assembly 100A<a preventing wall portion 290 as a portion to be prevented is provided. The preventing wall portion 290 is fixed inside the apparatus main assembly 100A and beside the movement path of the pulling-out member 213. As shown in FIG. 24, when the pulling-out member 213 is inserted in the pushing-in direction D1 in the state in which the stopper portions 280a are projected from the bottom surface of the pulling-out member 213, one of the stopper portions 280a contacts the preventing wall portion 290, so that the pulling-out member 213 cannot be inserted further. Thus, the preventing wall portion 290 contacts the stopper portion 280a taking the first attitude to prevent the movement of the pulling-out member 213.

As described above, according to this embodiment, the stoppers 280 are provided on the cartridges P3 and the function (action) of the stopper portions 280a is released only when the predetermined cartridges P3 are mounted in the associated mounting portions 13f of the pulling-out member 213. On the other hand, when the predetermined cartridges P3 are not mounted in the associated mounting portions 213f, the insertion of the pulling-out member 213 into the apparatus main assembly 100A is prevented by the function of the stopper portions 280a. Therefore, the user can know the erroneous mounting of the cartridge P3, the cartridge P3 forgot to be mounted, or the incomplete mounting of the cartridge P3, into the pulling-out member 213 during the insertion of the cartridge P3 into the pulling-out member 13. Further, the user can know the erroneous mounting portion. For that reason, a trouble such as image defect or image deterioration can be prevented. Further, the user can solve the trouble quickly.

Further, in this embodiment, the stoppers 280 are provided on the cartridges P3 which are consumable, so that compared with the case where the stopper 280 is provided on a main frame of the apparatus main assembly 100A or the pulling-out member 213, a degree of durability can be set at a lower level and thus cost reduction can be realized. Further, when the stopper 280 is broken, the broken stopper 280 can be relatively easily remedied by exchanging the cartridge P3.

(Other Embodiments)

Figure 25:
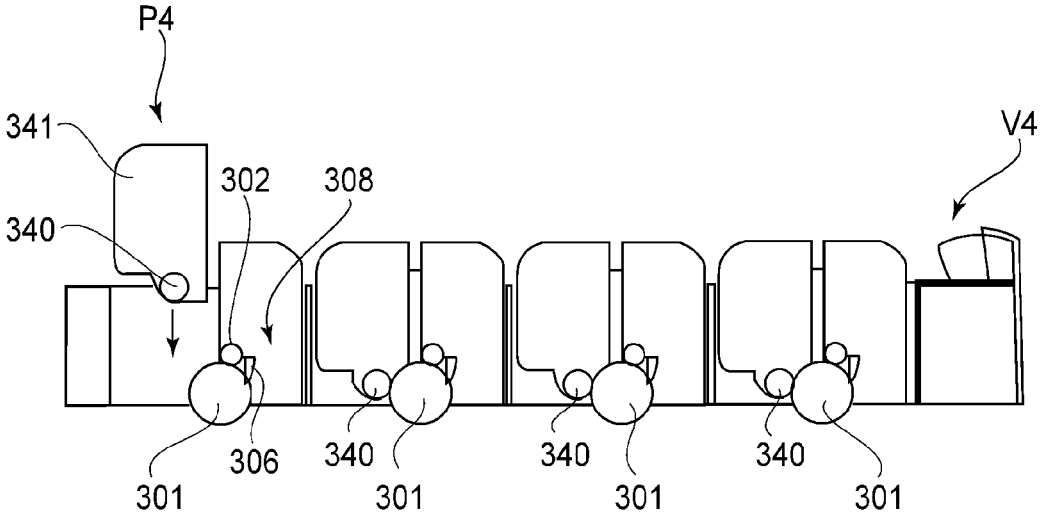
FIG. 25 is a sectional view of a pulling-out member and cartridges in another embodiment.

In Embodiments 1 to 3, as the cartridge, the so-called process cartridge prepared by integrally supporting the photosensitive member unit (8, 208) and the developing unit (4, 204) is described. However, the present invention is also applicable to, as shown in FIG. 25, a developing cartridge P4 which is prepared separately from a photosensitive member unit 308 and includes a developing unit as a cartridge and is further applicable to a toner cartridge including a toner container. That is, each developing cartridge including a developing roller 340 and a toner accommodating portion 341 is mountable into and demountable from a pulling-out member U4. In the pulling-out member U4, the photosensitive member unit 308 including a photosensitive drum 301, a charging roller 302 and a cleaning blade 306 is also provided.

In Embodiments 1 to 3, a color tandem constitution in which the four cartridges (P, P3) are arranged side by side is described. However, the present invention is also applicable to a monochromatic cartridge using a single cartridge (P, P3). In this case, with respect to the erroneous mounting prevention, the constitution of the present invention is effective, e.g., when a similarly shaped cartridge for another type machine is erroneously mounted.

In Embodiments 1 to 3, the transfer belt 11 for conveying the recording material S onto the surface of the photosensitive drum 1 and then directly transferring the developer image from the surface of the photosensitive drum 1 onto the recording material S is described. However, the transfer belt 11 may also be an intermediary transfer belt of the type wherein the developer image formed on the photosensitive drum is transferred onto the intermediary transfer belt and then is finally transferred onto the recording material.

In Embodiments 1 to 3, the constitution in which the pulling-out member (13, 113, 213) is mounted into and demounted from the apparatus main assembly 100A in the direction perpendicular to the axial direction of the photosensitive drum 1 is described. However, the mounting direction may also be the direction parallel to the axial direction of the photosensitive drum 1. In this case, the positions and directions of the members (the stoppers and the like) constituting the movement preventing mechanism for preventing the mounting of the pulling-out member (13, 113, 213) into the apparatus main assembly 113 are changed.

According to the above-described embodiments in the case where the cartridges are not mounted in the pulling-out member at predetermined portions, the user can recognize the erroneous mounting during the operation for inserting the pulling-out member into the apparatus main assembly. Thus, the trouble such as the image defect or the image deterioration is prevented.

As described hereinabove, according to the present invention, in the case where the cartridge associated with the cartridge mounting portion is not mounted into the cartridge supporting member at a predetermined position, during the operation for inserting the cartridge supporting member into the apparatus main assembly, the user can recognize the erroneous mounting.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 181735/2009 filed Aug. 4, 2009 and 161226/2010 filed Jul. 16, 2010, which are hereby incorporated by reference.

What is claimed is:

1. An image forming apparatus for forming an image on a recording material, said image forming apparatus comprising:

a cartridge including a developer accommodating portion for accommodating a developer for developing an electrostatic latent image formed on a photosensitive member;

a cartridge supporting member including a mounting portion in which said cartridge is detachably mountable, said cartridge supporting member being movable between an inside position in which an image is to be formed by said cartridge mounted in the mounting portion inside a main assembly of said image forming apparatus and an outside position in which said cartridge is to be mounted and demounted outside the main assembly; and a preventing member movable between a first position in which said preventing member prevents, when said cartridge is not mounted in the mounting portion, movement of said cartridge supporting member from the outside position to the inside position by contacting a portion to be prevented, and a second position in which said preventing member permits, when said cartridge is mounted in the mounting portion, the movement of said cartridge supporting member from the outside position to the inside position, wherein the second position is retracted from the first position, wherein said cartridge supporting member includes releasing means for positioning said preventing member at the second position, said releasing means capable of contacting said preventing member to position said preventing member at the second position even when said cartridge is not mounted in the mounting portion.

2. An apparatus according to claim 1, further comprising second releasing means for positioning said preventing member at the second position, said second releasing means capable of contacting said preventing member.

3. An apparatus according to claim 2, wherein said preventing member is provided in said cartridge supporting member, the portion to be prevented is provided in the main assembly, and said second releasing means is provided in said cartridge.

4. An apparatus according to claim 2, wherein said preventing member is provided in the main assembly, the portion to be prevented is provided in said cartridge supporting member, and said second releasing means is provided in said cartridge supporting member and said cartridge.

5. An apparatus according to claim 1, wherein said preventing member is urged by an urging member so as to be placed in the first position.

6. An apparatus according to claim 1, wherein said cartridge is a process cartridge including the photosensitive member, the developer accommodating portion, and a developing member for developing the electrostatic latent image with the developer.

7. An apparatus according to claim 1, wherein said cartridge is a developing cartridge including the developer accommodating portion and a developing member for developing the electrostatic latent image with the developer.

8. An image forming apparatus for forming an image on a recording material, said image forming apparatus comprising:

a cartridge supporting member including a plurality of mounting portions in which a plurality of cartridges is detachably mountable, each cartridge including a developer accommodating portion for accommodating a developer for developing electrostatic latent image formed on a photosensitive member, said cartridge supporting member being movable between an inside position inside a main assembly of said image forming apparatus and an outside position outside the main assembly; and a plurality of preventing members provided, movably relative to said cartridge supporting member, corresponding to the plurality of mounting portions, wherein each preventing member is movable, when said cartridge supporting member is moved from the outside position to the inside position, between a first position in which each preventing member prevents movement of said cartridge supporting member from the outside position to the inside position by contacting the main assembly and a second position, retracted from the first position, in which each preventing member permits the movement of said cartridge supporting member and wherein each preventing member is movable to the first position, when an associated cartridge is unmounted in an associated mounting portion or when the cartridge different from the associated cartridge is mounted in the associated mounting portion and is movable to the second position only when the associated cartridge is mounted in the associated mounting portion, wherein said cartridge supporting member includes releasing means for positioning said preventing member at the second position, said releasing means capable of contacting said preventing member to position said preventing member at the second position even when said cartridge is not mounted in the mounting portion.

9. An apparatus according to claim 8, wherein each preventing member includes a portion to be contacted for positioning the preventing member at the second position in contact with a contact portion, the contact portion being provided on the associated cartridge such that the preventing member only contacts the contact portion when the associated cartridge is mounted in the associated mounting portion.

10. An apparatus according to claim 8, wherein said plurality of preventing members is provided at different positions with respect to a direction crossing a movement direction of said cartridge supporting member.

11. An apparatus according to claim 8, wherein the plurality of cartridges is four cartridges including the developer accommodating portions in which developers of yellow, magenta, cyan and black are accommodated, respectively, and wherein the associated cartridge is the cartridge including the developer accommodating portion in which the developer of a predetermined color is accommodated.

12. An apparatus according to claim 8, wherein each preventing member is provided in said cartridge supporting member at the first position so that the associated mounting portion is stopped at a position upstream of an opening provided in the main assembly with respect to a movement direction in which said cartridge supporting member is moved from the outside position to the inside position.

13. An apparatus according to claim 8, wherein said preventing member is urged by an urging member so as to be placed in the first position.

14. A cartridge detachably mountable to an image forming apparatus according to claim 8, comprising:

a contact portion for positioning the associated preventing member at the second position by contacting the associated preventing member provided correspondingly to the associated mounting portion when said cartridge is mounted in the associated mounting portion of the plurality of mounting portions; and a recessed portion for leaving, when said cartridge is mounted in a mounting portion different from the associated mounting portion, the preventing member provided correspondingly to the different mounting portion at the first position.

15. A cartridge according to claim 14, wherein said cartridge is a process cartridge including the photosensitive member, the developer accommodating portion, and a developing member for developing the electrostatic latent image with the developer.

16. A cartridge according to claim 14, wherein said cartridge is a developing cartridge including the developer accommodating portion and a developing member for developing the electrostatic latent image with the developer.

* * * * *